US010679592B2

(12) United States Patent
Van Den Broeck

(10) Patent No.: US 10,679,592 B2
(45) Date of Patent: Jun. 9, 2020

(54) TUNING OF A DRUM

(71) Applicant: Bram Van Den Broeck, Borgerhout (BE)

(72) Inventor: Bram Van Den Broeck, Borgerhout (BE)

( * ) Notice: Subject to any disclaimer, the term of this patent is extended or adjusted under 35 U.S.C. 154(b) by 0 days.

(21) Appl. No.: 15/884,330

(22) Filed: Jan. 30, 2018

(65) Prior Publication Data

US 2018/0233118 A1 Aug. 16, 2018

Related U.S. Application Data

(63) Continuation-in-part of application No. PCT/BE2016/000031, filed on Jun. 30, 2016.

(30) Foreign Application Priority Data

Jun. 30, 2015 (BE) ..... 2015/5412

(51) Int. Cl.
*G10D 13/02* (2020.01)
*G10G 7/02* (2006.01)

(52) U.S. Cl.
CPC ..... *G10D 13/023* (2013.01); *G10D 13/021* (2013.01); *G10G 7/02* (2013.01)

(58) Field of Classification Search
CPC ..... G10D 13/023; G10D 13/021; G10G 7/02
USPC ..... 84/411 R
See application file for complete search history.

(56) References Cited

U.S. PATENT DOCUMENTS 5,977,467 A * 11/1999 Freeland ..... G10G 7/02 84/297 S
8,742,242 B1 * 6/2014 Ribner ..... G10G 7/02 84/454
2012/0067192 A1 * 3/2012 Nielsen ..... G10G 7/02 84/454
2012/0240749 A1 * 9/2012 Bjornson ..... G10D 13/00 84/454
2013/0139672 A1 * 6/2013 Ribner ..... G10G 7/02 84/602
2014/0060211 A1 * 3/2014 Van den Broeck .... G10H 3/146 73/862.68

(Continued)

*Primary Examiner* — David S Warren
*Assistant Examiner* — Christina M Schreiber
(74) *Attorney, Agent, or Firm* — Schwegman Lundberg & Woessner, P.A.

(57) ABSTRACT

A method for assisting a user in tuning a drum comprising the steps of:

considering a strike on the drum whereby the strike is detected in a sensor signal in at least one of following domains: a time domain, a frequency domain, a complex domain;

recording a first sound fragment of the strike;

converting the first sound fragment from the time domain to the frequency domain;

analyzing the first sound fragment in order to detect a fundamental tone with fundamental tone frequency of the drum;

calculating an overtone frequency or overtone frequency range of a first overtone of the drum by means of a predetermined algorithm related to the fundamental tone frequency;

setting a filter with a pass frequency band covering the calculated overtone frequency or overtone frequency range; and indicating, via a user interface, at each further strike when the frequency of the first overtone detected in the pass frequency band is higher or lower than a target overtone frequency.

5 Claims, 11 Drawing Sheets

(56) References Cited

U.S. PATENT DOCUMENTS

| | | | | |
|---|---|---|---|---|
| 2018/0068646 | A1* | 3/2018 | Esparza | G10H 3/143 |
| 2018/0233118 | A1* | 8/2018 | Van Den Broeck | G10D 13/023 |
| 2019/0259361 | A1* | 8/2019 | Esparza | G01H 11/02 |

* cited by examiner

TUNING OF A DRUM

CROSS REFERENCE TO RELATED APPLICATIONS

This is a continuation-in-part application of International Application PCT/BE2016/000031, with an international filing date of Jun. 30, 2016, which International Application claims priorities from Patent Application No. BE201505412 filed in The Kingdom Of Belgium on Jun. 30, 2015.

TECHNICAL FIELD

The invention relates to a method for assisting a user in tuning a drum and particularly relates to an apparatus provided for performing the steps of the method for assisting a user in tuning a drum.

BACKGROUND

Drums exist in different shapes and sizes and are used mainly to make music. A drum kit thus typically comprises a plurality of drums, including a snare drum, a bass drum and several so-called toms. A drum kit can thus be seen as a set of drums. Percussion instruments such as congas, bongos and djembes are likewise deemed drums in the present description. The sound box of a banjo can also be deemed a drum. A drum is a musical instrument with resonant plate or membrane. A drum is typically formed as a hollow object wherein at least one side of the cavity has a substantially cylindrical opening, which opening is closed by stretching a skin over the rim of the opening. A percussion instrument is hereby obtained wherein the shape and size of the cavity determine a significant aspect of the sound. A drum is typically played by means of a medium such as a body part, brush, stick, mallet, bridge or comb in order to transmit a force whereby the membrane vibrates or resonates. Another important aspect of the sound is determined by the skin tightened over the opening, and particularly the tension of the skin. In drums with two or more skins the individual tension of the separate skins contributes toward the tuning, wherein the fundamental tone and the positions of the overtones thereof are determined by the tension of all the skins together. The tension of the skin is understood on the one hand to mean the average force with which the skin is tightened over the edges of the opening and on the other the uniformity of the distribution of force over the surface of the skin. Tuning of the drum is defined here as optimizing the tension of the skin.

US patent (Pub. No.: US 2013/0139672) describes a device and a method for tuning a drum. This document describes how a user must strike repeatedly on the edge of the drum and wherein an indication is then given as to whether the tension must be increased or decreased at this location. This takes place by measuring a first overtone at a first strike and comparing at each further strike the overtone measured therein to the previously measured first overtone. On the basis of this comparison an indication is given of whether the tension must be increased or decreased.

A drawback of this method is that it is assumed that the first overtone can be correctly detected at each strike. This is found in practice however to be certainly not the case, whereby a user can sometimes have considerable difficulty in tuning the drum.

It is an object of the present invention to provide a method and an apparatus wherein correct operation of the method and the apparatus is less dependent on accurate detection of the correct first overtone.

The invention provides for this purpose a method for assisting a user in tuning a drum, wherein the method comprises the following successive steps of:

considering a strike on the drum by a user;

recording a first sound fragment of the strike by means of a vibration sensor;

converting the first sound fragment from the time domain to the frequency domain;

analyzing the first sound fragment in the frequency domain in order to detect a fundamental tone of the drum, which fundamental tone has a fundamental tone frequency;

calculating an overtone frequency range of a predetermined overtone of the drum by means of a predetermined algorithm related to the fundamental tone frequency;

setting a filter with a pass frequency range comprising the calculated overtone frequency range so that at each further strike on the drum the frequency of the predetermined overtone of the drum is detectable within the pass frequency range;

indicating at each further strike via a user interface when the frequency of the first overtone detected in the frequency band is higher or lower than a target overtone frequency.

The method of the invention is characterized on the one hand by detecting a fundamental tone and on the other by calculating a predetermined overtone frequency, for instance that of the first overtone, on the basis of the fundamental tone frequency. The order of the predetermined overtone can be determined here as desired. It can for instance be an overtone of the fundamental tone which is of the second order. The predetermined overtone can however be determined by way of example such that it is the first overtone of the fundamental tone, the overtone frequency range of which comprises the first overtone, so that the frequency of the first overtone is detectable within the overtone frequency range calculated on the basis of a fundamental tone.

Reference is often made by way of example to the first overtone as predetermined overtone in the text below. The invention is however not limited to predetermined overtones of the first order but also comprises further predetermined overtones. Further predetermined overtones can be understood to mean overtones of second or higher order.

A frequency band, also referred to in this text as frequency range, can have according to this invention an indeterminate width, and consists of at least one frequency. A power spectrum of a frequency band with more frequencies can comprise different amplitude peaks associated with the frequencies in the frequency band.

A pass frequency band or pass frequency range is the range defined by a filter, wherein all frequencies lying within this range can be taken into consideration in determining a fundamental tone or an overtone thereof. At least one frequency of a pass frequency band or pass frequency range delimits this pass frequency band or this pass frequency range. Reference is sometimes made in the text to a situation in which the filter lies or is placed around a frequency range, this being understood to mean that the pass frequency band of the filter at least fully comprises this frequency range. Each part of a pass frequency range or pass frequency band defined by the filter can also be deemed a pass frequency range or a pass frequency band in accordance with this text. For the sake of convenience the pass frequency band is referred to in some cases in the text with the term frequency band or frequency range, particularly when this is stated in a context relating to the filter or the determining of a fundamental tone, an overtone, their respective frequency or an amplitude peak by means of analyzing a sound fragment.

In setting of the filter reference is made in this text by way of example and for the sake of convenience to setting thereof on the basis of a fundamental tone frequency. This then takes place on the basis of a predetermined algorithm. The setting of the filter on the basis of a fundamental tone frequency range on the basis of a predetermined algorithm is however also included in the context of this invention. Determining of the pass frequency range is important for a correct operation of the method of the invention, and this range need not necessarily be set on the basis of a determined fundamental tone frequency, and it is likewise possible according to the method of this invention to set the filter on the basis of a determined fundamental tone frequency range comprising the fundamental tone frequency. The pass frequency range of the filter is preferably determined on the basis of one fundamental tone frequency, although determining a pass frequency range of the filter on the basis of for instance the delimiting frequencies of a frequency range, such as a fundamental tone frequency range, is also included in this invention.

A fundamental tone covers a frequency range which consists of at least one frequency and which comprises at least the fundamental tone frequency. When the fundamental tone covers a frequency range consisting of only one frequency, this is therefore the fundamental tone frequency. The fundamental tone typically comprises by way of example multiple amplitude peaks, at least one of which can be deemed as being associated with the fundamental tone frequency. The frequency associated with the amplitude peak with the maximum peak value within the frequency range of the fundamental tone can further be deemed the fundamental tone frequency. Within a power spectrum the fundamental tone covers for instance a frequency range which extends within a certain proximity of the fundamental tone frequency. A fundamental tone frequency can also be determined in other manner according to the invention, as will be further elucidated.

A fundamental tone of a skin is generated when a skin vibrates in the lowest vibration mode or form of vibration which is typically circular symmetric and wherein the nodal line coincides with the periphery of the skin tensioned over the rim of the drum. By way of example a fundamental tone is a spectral range or frequency range associated with a peak value which comprises the most energy within a frequency spectrum, magnitude spectrum or power spectrum of a sound fragment of a typical center strike on a drum from which all skins can resonate freely.

The fundamental tone frequency range or the fundamental tone frequency band comprises at least the fundamental tone frequency, which can thus be detected in this fundamental tone frequency range or this fundamental tone frequency band. The fundamental tone thus lies at least partially within the fundamental tone frequency range.

The fundamental tone frequency is the frequency of a fundamental tone. Deemed on the one hand as fundamental tone frequency in this text is: a frequency associated with an amplitude peak lying within a fundamental tone frequency range or a fundamental tone. By way of example the fundamental tone frequency can on the one hand, as already described above, be the frequency associated with the maximum amplitude peak within a fundamental tone. The fundamental tone frequency can on the other hand derive from the frequency associated with the maximum amplitude peak within a fundamental tone, such as an approximation or a rounding-off thereof. As a fundamental tone frequency can likewise be deemed in this text: the frequency obtained by collectively considering and processing multiple frequencies in order to arrive at a fundamental tone frequency. An example hereof is taking a median or an optionally weighted average, or a spectral centroid of multiple frequencies of a fundamental tone in order to determine the fundamental tone frequency of a fundamental tone. The frequency range from which the spectral centroid is taken preferably also comprises here the frequency associated with the maximum amplitude peak within a fundamental tone. This tone determining technique is generally known to the skilled person. This technique is employed, among other purposes, to determine a pitch of a specific frequency range of a sound fragment on the basis of a weighted average of the amplitudes of the frequencies thereof. Calculating a spectral centroid of a considered frequency band is a way of calculating a center of mass of the considered frequency band in order to determine which frequency is the most significant for the perception of the pitch of the considered frequency band. When the fundamental tone frequency band is considered, or at least a part thereof, this center of mass can be regarded as a fundamental tone frequency. The frequency regarded according to this invention as the fundamental tone frequency can however also be derived therefrom, such as an approximation or a rounding-off thereof, wherein the fundamental tone frequency is for instance an approximation or a rounding-off of a spectral centroid of a frequency range within a fundamental tone, which also comprises the frequency associated with the maximum amplitude peak within the fundamental tone. Taking two or more spectral centroids from the two ranges, which for instance lie higher and lower within a determined range of the frequency with the maximum amplitude peak within the fundamental tone, so that based on these spectral centroids a fundamental tone frequency is ultimately determined by means of a further processing, is a suitable technique according to this invention for determining a fundamental tone frequency. The resulting frequency is then regarded as fundamental tone frequency. In similar manner a frequency of an overtone, such as for instance the first overtone frequency, can be determined via similar techniques. Other methods are also suitable for this purpose.

An overtone is related to a fundamental tone irrespective of the order of the overtone. An overtone covers a frequency range consisting of at least one frequency and comprising at least the overtone frequency. When the overtone covers a frequency range consisting of only one frequency, it is therefore the overtone frequency.

An overtone frequency range or an overtone frequency band comprises at least an overtone frequency which can thus be detected in this overtone frequency range or this overtone frequency band. The overtone thus lies at least partially within the fundamental tone frequency range.

A first overtone covers a frequency range consisting of at least one frequency and comprising at least the first overtone frequency. When the first overtone covers a frequency range consisting of only one frequency, it is therefore the first overtone frequency.

The overtone frequency range of the first overtone or the overtone frequency band of the first overtone, also referred to as the first overtone frequency range or the first overtone frequency band, then comprises at least the first overtone frequency, which first overtone frequency can thus be detected in this first overtone frequency range or in this first overtone frequency band. The first overtone thus lies at least partially within the first overtone frequency range.

The first overtone frequency is the frequency of a first overtone. Deemed in this text as a first overtone frequency are: a frequency associated with an amplitude peak lying within a first overtone frequency range or a first overtone. By way of example the first overtone frequency can on the one hand be the frequency associated with the maximum amplitude peak within a first overtone. The first overtone frequency can on the other hand be derived from the frequency associated with the maximum amplitude peak within a first overtone, such as an approximation or a rounding-off thereof.

Likewise deemed a first overtone frequency in this text is: the frequency obtained by collectively taking multiple frequencies into consideration in order to determine a first overtone frequency. An example hereof is taking an average or a spectral coefficient of multiple frequencies of a first overtone in order to determine the first overtone frequency of a first overtone, wherein these frequencies preferably also comprises the frequency associated with the maximum amplitude peak within a first overtone. The first overtone frequency can however be derived from the frequency determined according to the method as described above, such as an approximation or a rounding-off thereof.

Similarly to the first overtone frequency, the overtone frequencies of a higher order than the first are also thus defined.

A target overtone or a target overtone frequency is an overtone frequency used as reference to determine whether an overtone frequency determined in the sound fragment of a strike is the same as or differs therefrom. A target overtone frequency can be determined as desired, or can be an overtone frequency measured in a previous strike, or can be calculated on the basis of a determined fundamental tone.

An ideal overtone frequency is related to a determined target fundamental tone with a determined frequency and reverberation duration. An ideal overtone frequency can be an ideal first overtone frequency or can be an ideal overtone frequency of an overtone of a higher order than the first overtone of a fundamental tone. An ideal overtone frequency can be determined by multiplying a determined fundamental tone frequency by a predetermined multiplication factor, which can be a constant coefficient. This constant coefficient can be set individually per skin and, in the case of a drum with a plurality of skins, either have the same value for all skins thereof or have a different value for all skins thereof. The magnitude of the difference between the constants for instance represents an indication here of the reverberation duration. A constant can be determined experimentally, among other ways by measuring the reverberation duration of a center strike on a drum with determined fundamental tone.

A target fundamental tone is achieved, or approximately achieved, when all skins of a drum have been tuned to their individual ideal overtone frequencies. A target fundamental tone or a target fundamental tone frequency can be determined as desired, or can be a fundamental tone frequency measured at a previous strike or can be calculated on the basis of another fundamental tone or can be calculated on the basis of at least one overtone.

A fundamental tone is considerably easier to detect than the first overtone. The susceptibility of the method according to the invention to error is hereby greatly reduced compared to existing methods. The first overtone of the drum is then calculated on the basis of the fundamental tone frequency by means of a predetermined algorithm. A filter is then placed with a pass frequency range comprising the calculated overtone, for instance by placing a filter around a frequency band in which the calculated overtone frequency range is located. At each further strike this allows the first overtone, or further predetermined overtone, to be detected in simple and efficient manner. Because the filter lies around the pass frequency range where the first overtone can reasonably be expected at each further strike, the overtone can be detected in simple manner. The probability of the fundamental tone or overtone of an undesired order being detected, in the case of the first overtone that of an order higher than the first, is thus highly limited or even precluded. The susceptibility of the method to error is thus improved considerably. At each further strike the measured frequency of the overtone is then compared to a target overtone frequency so as to indicate to the user whether and how the tension of the skin of the drum has to be adjusted. Use of the method will in this way assist a user in tuning a drum. The target overtone frequency can be a calculated frequency, a frequency chosen by the user or a previously detected frequency. Indication of how the tension of the skin must be adjusted is for instance possible simply by showing the measured overtone frequency on a display without explicitly indicating whether this is higher or lower than a target frequency, but wherein it will be apparent that the user him/herself can assess whether this measured overtone frequency is higher or lower than a target frequency such that this is indeed indicated indirectly by showing the measured overtone frequency.

Indicating via a user interface at each further strike whether the frequency of the first overtone detected in the pass frequency range is higher or lower than a target overtone frequency is understood in this invention to mean any indication of difference, wherein also included is the indication of an overtone frequency range or an overtone frequency from which a difference from a target overtone frequency can be inferred without this target overtone frequency having to be explicitly shown or without the measured overtone frequency having to be explicitly shown or their mutual difference having to be explicitly shown.

The manner in which an indication of difference is shown is further of minor importance according to the invention. It is for instance of minor importance according to this invention whether or not a quantity is stated in this indication of difference or, if a quantity is stated, whether the stated quantity of a fundamental tone or overtone is a frequency expressed in hertz or a pitch expressed in musical naturals with an offset, or an indication of tension or compressibility expressed by a digit, number, letter, a color, a symbol and so forth.

An indication of a difference can likewise be shown, optionally together with at least a target overtone frequency or a measured overtone frequency or an approximation thereof. An auditive signal, for instance a tone corresponding to a target tone frequency, can alternatively be reproduced, wherein a tone corresponding to a detected overtone frequency is simultaneously also reproduced as sound signal, so that the user can infer auditorily whether both signals are identical or different.

In the description below the first overtone is selected by way of example as predetermined overtone, although it will be apparent that overtones of higher order can also be selected.

During detection of the fundamental tone an amplitude of the fundamental tone is preferably further determined, and wherein an overtone amplitude of the first overtone is further calculated by means of a further predetermined algorithm related to the amplitude of the fundamental tone, and wherein setting of the filter further comprises of setting the filter around an amplitude range which comprises the calculated overtone amplitude. The filter is hereby placed not only around the frequency band in which the first overtone of the further strike is expected, but also around the amplitude range within which the first overtone of the further strike is expected. The result hereof is that the certainty with which the first overtone can be detected at each further strike is considerably increased. This is because, by placing a filter around an amplitude range, background sounds which typically have an amplitude which is below the amplitude range, or erroneous measurements or background sounds which typically have an amplitude above the amplitude range, are disregarded in simple and automatic manner during detection of the first overtone. The first overtone can thus be determined easily and with high certainty. In the further description the first overtone will for the sake of convenience be selected as predetermined overtone, although it will be apparent that overtones of higher order can also be selected.

An amplitude is sometimes referred to in the text as a magnitude. According to this text an amplitude is deemed a quantitative determination of value which serves for instance as measure expressing a magnitude or intensity irrespective of the unit in which it is expressed.

An amplitude band, also referred to in this text as amplitude range, comprises a quantity of amplitudes and according to this invention can have an indeterminate width, so comprise an indeterminate number of amplitudes, and consists of at least one amplitude.

A pass amplitude band or pass amplitude range is the range defined by a filter, wherein all amplitudes lying within this range can be taken into account so as to determine a fundamental tone or an overtone, or a fundamental tone frequency or an overtone frequency.

In the case of a pass amplitude band or pass amplitude range at least one of both extreme amplitudes delimiting such a range is known.

The fundamental tone amplitude range then comprises at least the fundamental tone frequency amplitude, which can be detected in the fundamental tone amplitude range. An overtone amplitude range then comprises at least an overtone frequency amplitude which can be detected in the overtone amplitude range. The overtone amplitude range of the first overtone then comprises at least the amplitude of the first overtone frequency of a fundamental tone of determined frequency, which first overtone amplitude can be detected in the first overtone amplitude range.

The method preferably comprises of determining at each further strike the frequency of the first overtone in the pass frequency band and comparing this frequency to the target overtone frequency. A target overtone frequency considered as ideal overtone frequency by a user allows uniform tuning of a drum skin, with the result that a predetermined target fundamental tone is immediately obtained or approximately obtained. Employing different ideal overtone frequencies for the individual skins of a drum allows tuning of the drum to a target fundamental tone wherein the resonance duration can be influenced and shortened. Employing ideal target overtones further allows tuning of different drums so that a well-defined interval between the fundamental tones of different drums can be obtained or approximated, optionally with influenced resonance duration. The calculated overtone frequency is calculated on the basis of the frequency of the fundamental tone.

The fundamental tone is the primary tone generated by a strike on the drum. The overtones can be calculated on the basis of predetermined algorithms. When for instance the calculated first overtone frequency is an ideal overtone and is set as target overtone frequency, at each further strike the first overtone can be compared to the calculated overtone and the drum will be tuned to the ideal overtone.

The use of a target overtone frequency differing from an ideal overtone frequency allows uniform tuning of a drum skin with certainty, though does not necessarily have the result that a predetermined target fundamental tone is obtained with certainty. This is because, when an overtone is first measured, and further overtones are then tuned to the first measured overtone, there is the chance that the first measured overtone deviates from the ideal overtone. Alternatively, the ideal overtone can be calculated on the basis of a predetermined algorithm on the basis of a freely chosen or predetermined fundamental tone. As further alternative, the target overtone frequency can be set manually by the user. As further alternative, a previously detected overtone can be set as target overtone. The target overtone frequency allows uniform tuning of a drum skin, but does not necessarily have the result that a predetermined target fundamental tone is obtained immediately. Tests have shown that the drum can hereby be tuned considerably better such that the drum can better live up to its full potential when it is played.

The calculation of ideal first overtones on the basis of a target fundamental tone and utilization thereof as target overtone for the purpose of performing the steps according to the method of this invention results in a considerable time-saving. This time-saving occurs because the user, on the basis of a target fundamental tone to be determined by him/herself, can tune the skins of a drum to the associated ideal overtones of this target fundamental tone so that the drum will be tuned such that the final fundamental tone obtained after tuning to the ideal overtone approximates the above stated target fundamental tone or corresponds thereto.

The ratio between a measured fundamental tone of a drum and a measured overtone thereof in the case of uniform and equal skin tension of all skins of a drum can be employed in the algorithm for calculating the ideal overtone of a target fundamental tone of said drum. In the case of a drum which has two skins, by tuning the individual skins thereof to a differing ideal first overtone a predetermined target fundamental tone can be obtained, or approximately obtained, which is provided with a tone bend over the duration of a resonance of a strike and wherein a shortened reverberation duration of the strike on the drum also occurs. The reverberation duration, or the resonance, is thus determined by the individual tuning of the individual skins, wherein the magnitude of the interval between for instance the first overtones of the individual skins influences the reverberation duration of the drum. For a musically optimal sound the ideal overtones of both skins then lie apart in accordance with the tone intervals associated with a melodic interval on a diatonic scale.

Tests have shown that with uniform skin tension a drum is notably better tuned, whereby the drum better lives up to its full potential when it is played. Further tests have shown that a set of drums with uniform individual tuning, and wherein the individual drums in the set are likewise tuned such that a melodic interval is obtained between their relative fundamental tones, realize their full potential notably better when played in combination with other melodically tuned instruments.

The method preferably further comprises of indicating to a user via the user interface that a center strike on the drum is desired before the step of recording the first sound fragment, and indicating to the user that an edge strike on the drum is desired following the step of recording the first sound fragment. The user is hereby better guided when going through the steps of the method for tuning the drum. This feature is based on the insight that a fundamental tone is considerably easier to detect in the case of the center strike than in the case of an edge strike. Centre strike is defined here as a strike on the skin in a central zone of the skin, wherein the skin can preferably vibrate freely. In the case this relates to a drum with more than one skin, all skins must be able to vibrate freely so that the fundamental tone of the drum can be generated in dominant manner during a center strike. The air present on both the upper side and underside of all skins must for this purpose also be able to move freely. In the case of a drum with a cavity having two or more openings, wherein not all openings are closed by a skin, the air in the cavity and widely around the openings must also be able to vibrate freely so that the fundamental tone can be generated in clearly pronounced manner by a center strike on a skin.

During tuning of the skin the tension thereof has to be adjusted. Mechanical, pneumatic, hydraulic tuning control means are usually provided for this purpose, such as for instance tensioning members or lugs equipped with tuning pegs, tightening screws, ropes, cables, clamping points, hooks, rings, hoops or the like, which allow adjustment of the tension or the pressure on the drum skin. They are typically present close to the rim thereof, around the periphery of the skin. The area of the drum skin close to these tuning control means is sometimes also referred to in this text as tuning control location. Also included under tuning control means are systems or mechanisms intended to adjust the skin tension around the whole periphery of the skin in one operation, and here the tuning control location is then the whole skin. Examples of this type of tuning control means are: the mechanism of a kettledrum operated via the foot pedal or the mechanism of so-called 'Rototoms' which is operated via rotation of a tensioning ring.

During vibration of the skin overtones are created which have a pitch related to, among other factors, the tension of the skin. During vibration of the skin most overtones occur close to the edge rather than in the center of the skin. An edge strike activates modes of vibration or forms of vibration in which the overtones have a strong presence. When a skin is struck close to the outer edge, determined forms of vibration with nodal circles and nodal diameter lines are activated, whereby overtones of the fundamental tone typically have a more pronounced presence in the frequency spectrum than in the case of a strike in the center of the skin.

When a drum has to be tuned, the tension of the skin is typically adjusted at the edge. Edge strikes will therefore be requested for each of the further strikes. The first overtone will then be detected in a sound fragment of this edge strike and compared to the target overtone such that the user can tension or slacken the skin, preferably at the position of the edge strike, on the basis of the indication of whether the overtone is higher or lower than the target overtone. The edge strike and the recording of the sound fragment by means of the vibration sensor are preferably performed for this purpose close to the tuning control location of the tuning control means which the user wishes to adjust.

Detection of a frequency of a first overtone in the frequency band preferably comprises the steps of:

considering a further strike on the drum;

recording a further sound fragment of the strike by means of the vibration sensor;

converting the further sound fragment from the time domain to the frequency domain;

setting the filter;

analyzing the further sound fragment in order to detect within the frequency band an amplitude peak which is regarded as first overtone of the further strike;

indicating via a user interface whether the frequency of the first overtone is higher or lower than the target overtone frequency.

By performing the above steps a new sound fragment can be recorded at each further strike which is then analyzed in order to determine the first overtone, and in particular the frequency thereof, for instance on the basis of the amplitude peaks present in the frequency band.

Analysis of the further sound fragment for the purpose of detecting an amplitude peak within the frequency band preferably further comprises, when multiple amplitude peaks are detected within the frequency band, of selecting the amplitude peak with the lowest frequency as first overtone. This step is optionally supplemented by searching for a peak with a higher amplitude located in a certain proximity of this peak with the lowest frequency within the frequency band in an adjacent subsequent and/or preceding frequency range, wherein the adjacent frequency range which is searched is typically smaller than the frequency band itself. Depending on the width of the frequency band it is possible that further overtones, such as the second overtone, also fall within the frequency band. It is even possible here that the amplitude of the second overtone is greater than the amplitude of the first overtone. For a specific tuning the second overtone is typically situated at a determined minimum frequency interval from the first overtone in the frequency spectrum, irrespective of the amplitude of the two overtones relative to each other. Since in the optional additional step as stated above a search is only made for a suitable amplitude peak within a determined frequency interval in the proximity of the first detected peak with the lowest frequency within the frequency band, which is assumed to correspond to the first overtone until an alternative suitable peak is found in the proximity thereof, it is possible to avoid a higher order overtone with a higher amplitude, which could be present within the frequency band, still being detected as first overtone. Since the limited frequency interval of the first overtone within which the search is made is preferably smaller than the minimum interval present between the first overtone and the second overtone, an amplitude peak associated with an overtone of a higher order still erroneously being deemed the first overtone is avoided in robust manner. The frequency band of the filter, sometimes also referred to as pass frequency band or simply frequency band, is preferably selected such that the amplitude peaks of overtones of higher order fall outside this band.

The frequency band is more preferably selected such that the amplitude peak with the lowest frequency is always the first overtone. As further described in the text, the step of analyzing a second part of a first sound fragment is suitable for determining the selection of the frequency band in robust and adaptive manner. The operational certainty of the method according to the invention is thus further enhanced.

The filter is preferably of the bandpass filter type for allowing passage of said overtone frequency range. Alternatively, a combination of high-pass filter and low-pass filter could also be used. It is alternatively also possible to mask or allow passage of a range by using only a high-pass or a low-pass filter. In a preprocessing step undesired spectral signal content can be removed here in analog and/or digital manner in the time and/or frequency domain, whereby a signal function is obtained which is suitable for analysis of the remaining overtone frequency range for tone determination. The filter can either form part of a signal conditioning step in a signal acquisition circuit or be set in analog or digital manner during the signal processing, for instance prior to the conversion from the time domain to the frequency domain. It is on the other hand equally possible, after conversion from the time domain to the frequency domain, to take into account only a determined overtone frequency range for fundamental or overtone determination, for instance by searching for a suitable value within a determined spectral range, index range, bin range of a frequency spectrum, power spectrum, magnitude spectrum, power spectral density, energy distribution table, spectral magnitude table or a variation hereof obtained by FFT, DFT, STFT or other methods suitable for the purpose. The frequency range which is thus considered for determining the overtone is therefore at least partially the pass frequency range of the filter.

A pass frequency range can likewise be obtained by using at least one band block filter which is for instance set to comprise a fundamental tone frequency range after determination of the fundamental tone in a center strike, so that a pass frequency range is obtained which comprises at least a predetermined overtone, whereby this is detectable within the pass frequency range of the block filter.

The invention further relates to a digital storage medium comprising instructions which, when executed, cause a data processing device to perform the steps of the method according to the invention. The invention further relates to an apparatus with a data processing device coupled operationally to a digital storage medium for performing the steps of the method according to the invention, which apparatus further comprises a microphone for recording the sound fragment. Alternatively, the apparatus is operationally coupled to a vibration sensor for recording the sound fragment. The vibration sensor is preferably a microphone. The apparatus further comprises a user interface or is further coupled operationally to a user interface.

With such an apparatus a user can apply the method according to the invention in simple manner for tuning a drum.

The apparatus can be formed according to the invention with a clamp or other mounting means for mounting the apparatus on a rim of a drum or another part of a drum or other instrument. The apparatus can be attached here mechanically, via an adhesive, magnetically or in other manner to the instrument. This facilitates use of the apparatus. It is also possible to mount only a part of this apparatus, for instance only the data processing part or only the part comprising the vibration sensor, on the rim or other part of the drum or a part of a musical instrument. Alternatively, the apparatus is formed integrally in a tuning key so that the device for tuning the drum comprises the tuning key and can also perform the method for indicating to a user how the drum must be tuned. The tuning key can further comprise a device for automatic motorized performing of the tuning operation based on the detected values for the overtone and/or fundamental tone close to a tuning control location.

As further alternative, the apparatus is formed integrally in a mechanical, analog or digital skin tension meter, which comprises a skin tension sensor, such as for instance a distance meter, hardness meter, a resistance meter or pressure gauge. The integrally formed apparatus is hereby equipped on the one hand with a skin tension sensor suitable for obtaining an indication of the physical skin tension without vibration of the skin being necessary for this purpose, and the apparatus is also equipped on the other with a vibration sensor for performing the steps according to the method of this invention. A skin tension sensor measures characteristics of a skin, such as the compressibility or the stiffness, of the whole skin or a portion thereof. For this purpose a skin tension sensor measures for instance a movement due to deforming of a skin over a determined distance under the influence of a determined force, or for instance a force exerted by the skin as resistance to deformation thereof, whereby on the basis of a measured distance of movement or a measured force an indication of the physical skin tension is obtained in relation to the compressibility or stiffness of the skin. The apparatus is on the other hand equipped with a vibration sensor suitable for determining the fundamental tone and overtone on the basis of an analysis of a sound fragment originating from the vibration sensor signal from a strike on the skin. An indication of the physical skin tension can hereby be shown via the user interface and the fundamental tone and overtone of a skin can be determined at a specific physical skin tension, whereby the obtained information is correlated. This provides the advantage that uniform tuning of the drum to a determined target overtone or tuning to a determined target fundamental tone can partially proceed in silence, wherein only in a pitch verification step does the frequency of the fundamental tone and overtone have to be determined on the basis of striking the skin in accordance with the method of this invention. Alternatively, the apparatus is formed as a vibration sensor which is integrated into an instrument or a part thereof and which is coupled operationally to an external data processing device which is suitable for performing the steps of the method according to the invention. The above stated alternative apparatus is preferably equipped here to communicate the optionally preprocessed sensor signal from one or more vibration sensors via wired or wireless communication technology to an external data processing device on which a software application is installed which is provided for the purpose of performing the steps of the method according to the invention and which processes the communicated sensor signals.

In another alternative embodiment another external data processing device, such as a tablet or smart device, functions as interface for the purpose of communicating at least a result of the tone determination to the user. Using this interface the user can possibly also control settings of the method, such as, among others, adjustment of the variables and the parameters of the algorithms, while the analysis of the sound fragments is performed by a data processing device according to the invention.

As further alternative the apparatus is formed with a vibration sensor suitable for performing the steps of the method according to the invention, wherein on the basis of an analysis of a sound fragment originating from the vibration sensor signal from a strike on the skin information is likewise communicated about at least one of the following strike characteristics: the strike hardness, the strike impact location, the strike impact moment over time. This information is for instance communicated to a smart device or data processing device such as a trigger interface, drum brain or computer. On such a smart device or data processing device a software application can be installed which is equipped to process the information input from the above stated apparatus, and wherein a result associated therewith is communicated via a user interface. The software application can thus be for instance a drum emulator software which outputs sound in relation to at least one of the received strike characteristics, or the software application can be a practice software which for instance compares the timing or the strike consistency of the received strike characteristics to target values and displays here to the user what the differences are or how timing can be improved and so forth. Included under software application is code or a program executed on for instance a server or a website, a program executed as a stand-alone computer program, an app, a widget, an applet, a software code, a firmware code, software, a plug-in for another computer program such as for instance a VST, a VSTi, a vamp and the like. Such a software application is alternatively provided for the purpose of performing the steps of the method according to the invention and either also connected operationally to a vibration sensor 23 or at least suitable for processing a sound fragment originating from a vibration sensor 23 in accordance with the steps of the method according to this invention.

Deemed as smart devices are data processing devices, such as: smart phones, smart watches, tablets, digital workstations, consoles, computers, notebooks, laptops; and likewise data processing devices integrated into, among others: mobile electronic devices, accessories, wearables and so forth. The successors hereof are also deemed smart devices.

As further alternative the apparatus is formed as a smart device such as a smart phone on which is installed a software application (also known as an app) which is provided for the purpose of performing the steps of the method according to the invention. This software application preferably provides the user with a summary of the tuning of, or in the vicinity of, the separate tuning control locations. The detected values of the overtones of the various locations and/or the fundamental tone are preferably shown together here so that a user has a clear visual overview thereof. A further preferred form of display comprises a visual representation of the skin or instrument and the separate tuning control locations, or an abstraction thereof. The display in a clear visual overview has the advantage that the different tuning values or the relative tuning differences between the tuning control locations can be clearly distinguished in relation to each other and/or in relation to a target frequency, such as for instance the calculated ideal overtone. The user can be further assisted here by the software application with guidance on how and which of the tuning control means to adjust. Overtone relations between tuning control means lying adjacency and above each other can also be indicated when the tuning is changed.

This software application preferably further comprises a provision for modifying the variables and parameters of the algorithms to user preferences; and a provision for calculating ideal overtones for the individual skins of a drum on the basis of a detected fundamental tone, a selected target fundamental tone or a calculated fundamental tone, which calculated ideal overtones are employed according to the method of this invention as target overtone for tuning the skins. Ideal overtones of an order to be predetermined by the user, such as for instance the first overtone, can in this way be calculated and employed as target overtone to tune the skins according to the method of this invention. Calculation of an ideal overtone can by way of example take place on the basis of a predetermined coefficient by which the fundamental tone is multiplied. It is alternatively also possible to determine ideal overtones of fundamental tones on the basis of a list or table in which the overtones and fundamental tones are stored. The above examples are not limitative, and other methods of determination are also included in the invention.

The software application more preferably comprises the option of calculating or determining ideal overtones from a related series of target fundamental tones at a well-defined interval or chosen mutual interval. The magnitude of this interval can preferably be determined by the user as desired, wherein the location of the target fundamental tones relative to each other is calculated or determined by the software application. Calculation of the location of individual target fundamental tones can by way of example take place on the basis of a predetermined coefficient by which the fundamental tones are multiplied. It is alternatively also possible to determine the location of the target fundamental tones on the basis of a list or table in which the mutual intervals and fundamental tones are stored. The above examples are not limitative, and other methods of determination are also included in the invention.

On the basis of each individual target fundamental tone the ideal overtone can then be calculated or determined per drum skin on the basis of predetermined parameters or on the basis of parameters to be determined by the user. This has the advantage that the user is guided in the determining of target tones in order to tune different instruments in relation to each other, so that for instance a harmonic interval or melodic interval can be obtained between the different fundamental tones of different drums by the tuning according to this method.

The software application preferably calculates or determines the individual target fundamental tones of individual drums forming part of a set of drums on the basis of a melodic interval between the target fundamental tones which determines the individual location of the target fundamental tones within the diatonic scale, wherein the ideal overtones of the separate skins of the individual drums are more preferably also calculated or determined on the basis of the calculated or determined target fundamental tones. In a preferred embodiment the magnitude of this melodic interval is determined by the user him/herself, wherein the magnitude of each interval, so each intermediate distance, also referred to as interval step or interval distance, between the target fundamental tones of the drums within the set is freely adjustable and corresponds to at least one of the following interval distances: a prime, a second, a third, a fourth, a fifth, a sixth, a seventh, an octave, a ninth, a tenth, an eleventh, a twelfth, a thirteenth, a fourteenth or a fifteenth, wherein it is possible to opt to augment or diminish them chromatically, whether they need to be minor or major.

In a preferred emolument the sequence of the drums within a set can be freely determined by the user. The user can by way of example order the drums on the basis of the diameter of the individual drums, for instance from small to large, wherein the calculated or determined melodic interval respects the drum sequence. As a result the respective fundamental tones of the drums ordered within the set of drums is determined with falling pitch, from high to low. The ordering need not however take place on the basis of diameter. The drum sequence can be freely determined by the user, wherein it is even possible that a user wishes the same fundamental tone to be determined for two individual drums.

In a further preferred embodiment the user designates within a set of drums a 'determinant drum', a fundamental tone of which can be calculated or determined. The fundamental tone of the determinant drum is preferably determined by the user him/herself and is the target fundamental tone of the drum. The fundamental tone of the determinant drum functions as reference fundamental tone to which, in relation to the determined interval magnitude, the target fundamental tones of the other drums of the set are calculated or determined by the software application. The determinant drum thus determines the target tuning of the other drums forming part of the set in accordance with a determined melodic interval. The software application here preferably also calculates or determines the ideal first overtones of the individual skins of the drums forming part of the set on the basis of their individual, calculated or determined target fundamental tones. There is hereby a direct relation between the ideal first overtones of the other drums and the determined fundamental tone of the determinant drum functioning as reference fundamental tone. The thus calculated or determined ideal first overtones per drum skin of the drums within the set are thus employed as ideal target overtone for tuning the individual skins according to the method of this invention.

The designation of a 'determinant drum' within a set of drums as desired by the user, wherein the fundamental tone thereof and the ordering of the determinant drum within the interval can likewise be freely determined by the user, has the advantage that the user him/herself can determine a target fundamental tone of the determinant drum in accordance with a personal preference or a musical requirement, and can at the same time designate which drums will have a higher and which drums a lower tuning. The software application subsequently calculates or determines in simple manner, in relation to their respective ordering and to the selected fundamental tone of the chosen determinant drum and on the basis of the selected interval settings, the higher and/or lower target fundamental tones of the other drums within the set, together with their respective associated ideal first overtones. As determinant drum can for instance be chosen the drum which has the greatest diameter within the set, wherein this drum is then assigned a fundamental tone which is the lowest tone in the melodic interval, whereby all other drums can be assigned a higher target fundamental tone in accordance with a determined melodic interval between the drums. Taking account of at least: the ordering of the drum in the set, the position of the drum in relation to the determinant drum, the number of skins, the determined interval between the drums, specific fundamental tones can for this purpose preferably be suggested as possible option to the user on the basis of a predetermined algorithm or on the basis of a value from a table. A diameter is preferably further determined per drum within the set and an indication is given of which fundamental tones are suitable for the drum diameter.

This integral calculating or determining method entails a considerable time-saving for the user without the user him/herself having to calculate the interval between the target fundamental tones of the drums and their associated ideal first overtones. This therefore results in optimal guidance of the user during tuning, wherein a set of drums is tuned according to the method of this invention to ideal target overtones of target fundamental tones calculated or determined within a melodic interval. The drums forming part of a set of drums which comprises a 'determinant drum' and which are not the determinant drum can be referred to as the other drums. The calculation or determination of the ideal first overtones of a target fundamental tone for the individual skins of another drum takes place on the basis of predetermined preferred settings, or parameters to be determined by the user, wherein by means of a predetermined algorithm or a predetermined value the position of the ideal overtone for a skin of a drum is expressed as a multiple of the target fundamental tone of this drum, optionally on the basis of an adjustable reverberation duration and on the basis of a desired interval between the first overtones of both skins, wherein the target fundamental tone of another drum is related to the reference target fundamental tone of the determinant drum. When the user is thus guided by the software application on the apparatus during tuning according to the steps of the method in order to tune a set of drums in melodic interval relation to each other, it is made possible for him/her to tune a set of drums in optimal and time-efficient manner.

Tuning to thus calculated or determined ideal overtones according to the method of this invention results either in a harmonic interval when drums are struck together or a melodic interval between the different fundamental tones of different drums forming part of a set when they are struck separately. A set of drums tuned via this method will hereby sound more harmonious when played together with other harmonically tuned types of instrument. This results in an improvement in the general sound and ensemble quality when the instrument is played in an instrumental line-up, such as for instance in an ensemble, orchestra or group of which the set of drums forms part.

This software application further preferably also comprises the option of storing settings, measurements and target tones, results of calculations and of sharing them with third parties. The apparatus on which the instructions are performed can for this purpose be provided with communication means suitable for digital or analog wireless data exchange or transfer or suitable for data exchange or transfer over wire such as radio frequencies, Bluetooth, Wi-Fi (Wireless Fidelity), USB, Thunderbolt, MIDI, ethernet and successors thereof. The software application is preferably likewise equipped to retrieve for further use settings, measurements, target tones, results of calculations and so forth stored or shared with third parties. The software application is more preferably expanded or expandable with additional functionalities such as, among others, a metronome, provision of: practice music, scores, training assistance, sound banks, emulation software, provision for making purchases, information provision, import of information or functionalities such as for instance preferred tuning settings, access to a user community, a forum, link to social media, following of lessons under external guidance and so on.

In a preferred embodiment the invention relates to an apparatus or a system equipped with one or more microphones which can be set by the user in an optionally variable position in relation to a membrane or the resonating structure of the drum.

The use of at least two microphones located at different positions would for instance allow a stereo input signal to be obtained consisting of two separate microphone signal channels, each with its own signal content. A location determination of the strike can for instance hereby take place on the basis of comparing and processing the signal content of the two separate microphone signal channels. Better amplitude determination of the strike can for instance hereby also take place on the basis of comparing and processing the signal content of the two separate microphone signal channels.

In an apparatus or system with more than one microphone signal channel the analysis of at least one of the following characteristics can thus provide insight into the location determination or the amplitude determination of a strike: a difference in spectral content of the signals from the separate microphone signal channels in the frequency domain, such as for instance the analysis of ongoing signal buffers and the progression in the magnitude and distribution of the magnitudes thereof over the overall detected spectrum or over multiple parts thereof, a difference in arrival time of an amplitude peak of a signal in the time domain, a difference in arrival time of a magnitude peak of a signal in the frequency domain over a determined time progression of the separate microphone signal channels, a difference in magnitude of the separate microphone signal channels, a difference in amplitude of the signal content of the separate microphone signal channels.

The possibility of variable setting of the position of at least one or more microphones as desired has the advantage that the user can direct one or more microphones toward a position or several positions in the surrounding space as desired so as to thus for instance enhance, obstruct or prevent the reception or recording of a determined input signal.

The user could thus aim the microphone at an impact position of a strike on the skin or at a strategic location on the membrane or at a resonating structure of the instrument, for instance close to a determined tuning control mechanism or a determined tensioning peg, in order to enhance the recording of the vibration frequency thereof in the input signal.

The user could equally well direct the microphone away from an impact position of a strike on the skin or direct it away from a location on the membrane or resonating structure of the instrument, for instance away from a determined tuning control mechanism or a determined tensioning peg, in order to obstruct or prevent recording of the vibration frequency thereof in the input signal.

Aiming a microphone at a determined location on the skin of a drum has the advantage that frequencies generated close to other locations on the skin will have a less strong or less pronounced presence in the microphone signal, and the frequencies generated close to the location at which the microphone is aimed will conversely have a stronger, more pronounced presence in the microphone signal.

The user can thus aim a microphone for instance at a location on the skin close to a tuning peg which he or she wishes to adjust in order to tune the drum. The frequencies and overtones generated close to this tuning peg are hereby recorded more loudly or more pronouncedly in the microphone signal and frequencies generated at other locations on the skin of the drum will be recorded less loudly or less pronouncedly in the microphone signal the further away from the recording range of the microphone these locations lie.

The invention will now be further described on the basis of an exemplary embodiment shown in the drawing.

Figure 15:
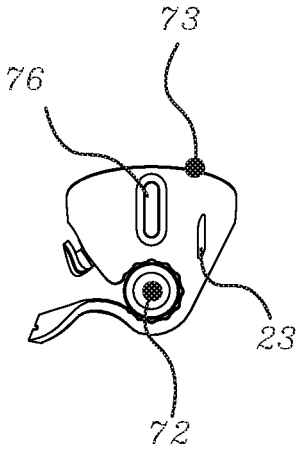
Figure 16:
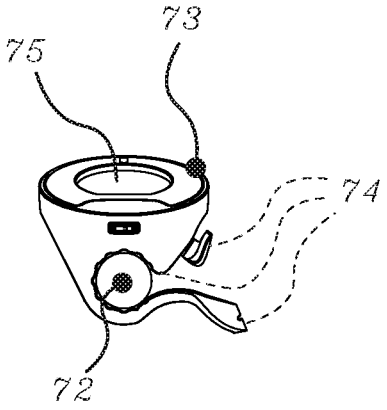

FIG. 15 illustrates a back view of an embodiment of the invention connected with a striking medium, whereby the connection means is represented as an elastic strap, and whereby said striking medium is represented as a drum stick; and FIG. 16 illustrates a front view of an embodiment of the invention connected with a striking medium, whereby the connection means is represented as an elastic strap, and whereby said striking medium is represented as a drum stick.

The same or similar element is designated in the drawing with the same reference numeral.

In the context of this description the following definitions will be used:

The resonance of a strike comprises all vibrations which occur as a result of an agitation of an object or object structure which causes mechanical vibration and/or elongation of this object or this object structure which may or may not be discernible to human hearing. The resonance duration of a strike is the duration for which these vibrations exist.

The acoustic characteristics of the resonance of a strike comprise all spectral information related to the vibrations occurring as a result of an agitation of an object or object structure which causes mechanical vibration and/or elongation of this object or this object structure which may or may not be discernible to human hearing. These characteristics can be detected, among other ways, in the time domain, the frequency domain or a combination thereof and are characteristic of and typical of a determined resonance of a determined object or a determined object structure occurring due to a determined agitation.

Agitation of an object or object structure is understood to mean: the addition of energy to this object or this object structure or removing energy from this object or this object structure, optionally through direct mechanical contact with this object or this object structure, such as for instance a strike with a body part or object, a friction with body part or object or a damping with a body part or object; or optionally through indirect mechanical contact by controlling the movement of the medium in which this object or this object structure is situated, such as the surrounding air, atmosphere or liquid. Each type of agitation results in a specific type of resonance of this object or this object structure with its own acoustic characteristics which can be distinguished from each other by analyzing the signal of the resonance of this type of strike in the frequency domain and/or time domain.

Considering a strike is understood to mean receiving the signal content of at least one or more input signals from one or more microphone signal input channel(s) which comprise(s) signal content information related to the recording of the resonance of a strike or at least a part of the resonance duration of a strike, in order to obtain at least one or more of the following data, insights or results by analyzing these signal contents:

a detection of a strike on a percussion surface, on a drum or on a component thereof, on a percussion instrument, on a drum skin;

a determination of a moment in time at which the strike occurs;

a determination of a moment in time at which a determined; part of the resonance duration of a strike occurs;

a determination of a moment in time at which a determined part of the resonation duration of a strike occurs, more specifically the part where an amplitude peak of the strike occurs;

a determination of a moment in time at which an amplitude peak of the strike occurs;

a determination of a vibration frequency associated with a strike or a determined part of the resonance duration thereof;

a determination of a vibration frequency associated with a determined part of the resonance duration thereof, such as a part which may partially comprise or may wholly not comprise an amplitude peak;

a determination of the impact location of a strike;

a determination of an impact location of a strike, a recognition of an object or an object structure on the basis of the acoustic characteristics of the resonance of a strike;

a determination of the distribution of the magnitudes of a resonance of a strike across the detected spectrum or a part thereof in order to obtain a determination of an impact location of a strike, a recognition of an object or an object structure on the basis of the acoustic characteristics of the resonance of a strike in the frequency domain;

a determination of the amplitude or magnitude of at least a part of the resonance duration of a strike from at least two microphone signal input channels.

This has the purpose of tuning an instrument, triggering an instrument for electronic or hybrid playing purposes, amplifying or recording an instrument.

An input signal, such as a microphone signal, vibration sensor signal, a sensor signal and so on, also referred to in this text as signal, is a signal which is analog or digital or otherwise originating from or generated by or influenced by a microphone or other vibration sensor under the influence of or resulting from the resonance of an object or object structure. This input signal runs over a signal input, a channel, a signal input channel or over a signal channel such as the microphone signal channel. The signal content of the input signal thus comprises information related to the resonance of an object or an object structure. The signal content of the input signal could be influenced in analog or digital manner by means of filtering, equalizing, amplification, windowing or other manipulation techniques.

A strike detection buffer, as well as a strike buffer, comprises signal content which for instance originates at least partially from the input signal and can be at least partially created on the basis of signal content which may or may not have been influenced in analog or digital manner.

In order to obtain a good understanding of the invention in relation to the prior art, the prior art is elucidated below with its drawbacks and with the differences between the invention and the prior art.

Described in US Patent (pub. No.: U.S. Pat. No. 8,759,655 B2) is an apparatus provided with a clamp for attaching the apparatus to a drum and which has only one microphone. This built-in microphone is situated on the underside of the apparatus and is directed away from the lower surface of the apparatus and directed toward the skin of the drum when this apparatus is mounted on a drum.

The position of the microphone of this apparatus cannot however be directed in variably adjustable or desired manner toward a determined location on the skin of the drum without rotating or moving the whole apparatus and hereby also influencing the angle of view on the display of the apparatus.

This apparatus has the drawback that it is hereby less suitable for recording, within the directional field of the microphone, frequencies such as for instance first overtones of the skin which are generated at a determined location on the skin, which location lies outside the directional field or recording field of the built-in microphone, in comparatively sufficiently loud or sufficiently pronounced manner without moving or picking up the apparatus itself in order to aim the microphone more easily at the impact location. The recording sensitivity of the directional field or recording field is not the same over the whole extent of this field. This fact likewise reinforces the effect that for instance overtones generated close to tuning pegs situated far from the apparatus, and so further outside the directional field of the built-in microphone, are detected comparatively less loudly or in less pronounced manner in the microphone signal.

In a preferred embodiment of the apparatus of the invention at least one microphone is provided which can be aimed without having to move the whole apparatus for this purpose.

By aiming the microphone the distance between the microphone and the skin can indirectly also be determined in variable manner, although in the preferred embodiment a control mechanism could also be provided with which the height distance of the microphone and the drum skin can be set or adjusted.

This has the advantage on the one hand that the angle of view of the screen can remain unchanged while the microphone can still be directed toward a determined preferred location by the user. On the other hand there is the advantage that the sensitivity for signals from the direction of the directional field of the microphone can be improved because the microphone can be directed toward locations on the skin where it is wished to record frequencies sufficiently loudly or in comparatively more pronounced manner.

In another preferred embodiment of the apparatus as described in this invention the apparatus is designed such that it can be held in the hand, whereby at least one microphone can be easily directed toward a determined location.

The frequencies generated at the location toward which the microphone is directed are, as also elucidated above, discerned as louder in the microphone signal. There are hereby more easily detectable within the microphone signal.

In order to tune a drum to an overtone generated on the skin close to a determined tuning peg it can be useful to actually direct the microphone toward a location on the skin where the movement, and so the air displacement, related to the vibration mode associated with this overtone is the highest, since at this location the overtone will have the most pronounced presence in the microphone signal and will thus be more easily detectable.

In order to tune a drum to a fundamental tone, it can be useful to direct the microphone toward a location in the center of the skin since the movement of the skin related to the vibration mode associated with the fundamental tone is the greatest here. At this location the air displacement caused by the fundamental tone is therefore also the greatest and the sound occurring as a result, i.e. the fundamental tone, will have the most pronounced presence in the microphone signal when a microphone is directed toward this location on the skin. This tone is hereby more easily detectable as magnitude peak value in a power spectrum of the signal.

Directing of the microphone toward a determined location can, as demonstrated above, thus enhance the detection of an overtone or a fundamental.

It may also be useful in this respect, though not essential, to provide a microphone at a location other than on the underside of the apparatus, whereby the directional range can optionally be increased or the visibility of the direction in which the microphone is aimed is improved, or the accessibility to the microphone to be directed is simplified. A height control can if desired also be provided via which the distance between the microphone and the skin can be determined independently of the direction of the microphone.

In a preferred embodiment wherein hands-free application is not required the apparatus has a clamp which is designed to mount the apparatus on the tensioning rim or hoop of a drum or on another component thereof by means of gripping jaws. This clamp is more preferably suitable for use with wooden, plastic and metal tensioning hoops in the most usual sizes for bass drums, toms, floor toms or snare drums. The tensioning width of the clamp between the gripping jaws more preferably has for this purpose a range which is sufficiently large and preferably comprises at least 20 mm to 50 mm. The clamp can for instance consist of at least one component, wherein the jaws thereof can move flexibly in relation to each other, although the clamp can equally well be a component structure consisting of several components.

The clamp of the apparatus in this invention can be embodied such that it is a separate component or a separate component structure which can be connected as desired to the other parts of the apparatus, whereby the clamp is removable. It may also be useful to provide a directional mechanism with determined freedoms of movement on the apparatus or on the clamp, such as for instance, though not limited thereto, a rod mechanism or a ball joint, or to provide for connection to the apparatus, which allows the whole apparatus to be individually oriented in accordance with determined freedoms of movement relative to the position of the clamp or a part thereof.

When in a preferred embodiment of the apparatus having at least two microphones at least one microphone is situated on the underside of the apparatus, both gripping jaws of the clamp are then preferably individually movable, and are also indirectly connected to the lower shell of the housing of the tuning apparatus in order to minimize or prevent disruptive vibration transfer between clamp and microphone.

The apparatus or system as described in this invention is equipped in a preferred embodiment with a manner of tuning or method of tuning which allows a simple focus mode to be implemented which has the purpose of simplifying the detection of a determined tone of a drum, such as a fundamental tone, or a determined overtone such as the first overtone.

In this manner of tuning or method of tuning or focus mode method the following steps are performed:

Firstly a first strike on a drum is detected by means of a strike detection analysis performed on at least one microphone signal.

This strike detection analysis of at least one microphone signal can for instance take place by observing the amplitude progression in the time domain, but more preferably takes place in the frequency domain by observing the magnitude progression of the microphone signal in one frequency band or in multiple frequency bands which optionally wholly comprises or comprise the overall bandwidth of the discerned spectrum.

For this purpose strike detection buffers are for instance analyzed in the frequency domain over a period of time by examining a power spectrum thereof and checking whether this complies with determined conditions and/or has acoustic properties which are related to the occurrence of a strike.

Detection of a strike in the time domain as described in U.S. Pat. No. 8,642,874 B2 has the drawback that without further frequency filtering of the input signal there is the risk that a loud tone in the ambient sound with acoustic properties other than those of a drum stroke can be erroneously interpreted as a drum stroke.

In the present invention on the other hand, the strike is detected in a preferred embodiment in the frequency domain. Detection of a strike in the frequency domain allows analysis of the frequency content of the signal in order to thus recognize the acoustic characteristics of a drum stroke and/or a determined instrument subject to the characteristic signal content, whereby it is possible on the one hand to reduce the risk of ambient sound erroneously being interpreted as a drum stroke and whereby it becomes possible on the other to distinguish from each other strikes on, or agitation of, determined types of instrument or determined drums or percussion instruments of for instance a drum kit or parts thereof 'Triggering' or 'detection of a strike' via strike detection analysis of strike detection buffers in the frequency domain in this way allows recognition of strike type with buffer lengths shorter than 500 ms, and preferably shorter than 25 ms, impact part recognition and/or instrument recognition in a short time period. Via strike detection analysis focused on impact part recognition, the impact location on an instrument can be found, for instance an edge strike can thus be distinguished from a center strike and an edge strike from a hoop strike by looking at the distribution and the progression in the magnitudes of the individual frequency bins in a power spectrum, optionally only within determined frequency bands of the spectrum, over a determined time period. The strike hardness of the strike, for instance for playing purposes or in order to determine the strike consistency, can for instance be determined by adding up the total magnitudes as detected within all bins or of only a part thereof. When different input signals are present, a more accurate picture of the strike hardness can be obtained by processing the signal content of the individual channels in relation to each other.

In a preferred embodiment of the apparatus of this invention the method further also comprises a step, or the apparatus also comprises the option, of giving via the user interface an indication related to the strike hardness of a detected strike. It is hereby possible for instance to indicate to the user via a sound, the loudness or volume of which is related to the detected strike hardness, or via a visualization related to the detected strike hardness, what the intensity of the detected strike hardness was or to what extent it differs at a subsequent strike from a preceding strike or from a determined target strike hardness.

In this strike detection analysis the resonance of a strike is detected in a microphone signal when the signal content satisfies at least one specific condition, such as for instance a magnitude limit value being exceeded for a determined time interval, possessing a determined acoustic signature or frequency content or a sudden increase in magnitude or a sudden decrease in magnitude over a determined time interval in the overall detected spectrum or in a part thereof, and the like. A strike type can for instance hereby be recognized, but also an agitation such as a strike on an object or object structure with another object or body part as well as an agitation such as damping of the vibration of an object or an object structure with another object or a body part can also be detected. It would thus be possible to detect in the signal when a cymbal is struck or when a resonating cymbal is damped by hand, when the cymbals of a high-hat are closed or opened with the foot pedal, when a resonating drum is struck or damped with the finger, stick or hand, and so forth. This information can be utilized for both tuning purposes and playing purposes. For playing purposes the strike detection, strike type recognition or impact part recognition could be related to separate MIDI files suitable for instance for electrical, electronic or hybrid percussion. The magnitude progression of the frequency content of the signal over a determined time period could thus also be linked adaptively to the user with specific output signals or sounds which are influenced by this magnitude progression, whereby a quasi-real-time percussion response occurs which has the tonal properties and/or the intonation of the strike which is detected in the input signal or related to the content of the strike buffer.

For tuning purposes or for tuning a drum, when a strike or optionally a damping thereof is detected, in a further step a strike buffer is recorded or compiled which comprises the total resonance duration of the strike or damping, or at least a part thereof.

This strike buffer is then preferably analyzed in the frequency domain in order to determine at least one of the following properties of the strike: the amplitude of the strike or damping, the impact location of the strike or damping, the initial moment in time, such as the moment of impact of the strike or the beginning of the damping, a suitable frequency peak of the strike associated with the fundamental tone or an overtone thereof, such as the first overtone, for tuning a drum, or the frequency distribution of the strike or the frequency progression of the strike.

In order to determine a suitable frequency peak of the strike associated with the fundamental tone or an overtone thereof, such as the first overtone, for tuning a drum, a frequency of a suitable magnitude peak related to a determined frequency bandwidth in a power spectrum is determined which is then deemed the most dominant frequency present in this strike buffer which comprises the overall resonance duration of the strike or damping, or at least a part thereof.

Via the user interface the user can subsequently activate a focus mode wherein detection is facilitated of determined magnitude peaks associated with determined frequencies or frequency bands in at least one frequency bandwidth optionally comprising the overall discerned frequency spectrum.

This focus mode can be deemed a simple focus mode. The simple focus mode can be activated via a command which the user inputs via the user interface, for instance such as via pressing a button, or via touching a specific zone on the user interface of the apparatus. In a preferred embodiment the apparatus has a button or touch zone which can be employed to switch the apparatus on or off, but also to activate or deactivate a focus mode.

The activation of the simple focus mode preferably takes place when a determined inputted or retrieved frequency or frequency band, which can be a target frequency, or a detected frequency or a detected magnitude peak or a value related to the foregoing, is displayed via the user interface as a result of a first strike. The shown value as described above can then be stored by the apparatus as target tone, which target tone can be utilized to calculate the difference from a tone detected at a subsequent strike when the focus mode is active.

The simple focus mode involves a focus area being defined around a determined frequency of frequency band deemed as target tone, which can be inputted or retrieved or be detected at a first or a preceding strike as a frequency or detected magnitude peak or which can have a value related to the foregoing, inside or outside which area the magnitude is measured for at least one frequency bin within a power spectrum.

This measured magnitude will be employed as reference magnitude, wherein in an additional step a magnitude manipulation operation is performed on the frequency content of at least a part of the strike buffer, which magnitude manipulation has the result that the relative magnitude ratios of the frequencies or frequency bins is changed within at least a part of the power spectrum of a strike buffer or a part thereof.

US patent (Pub. No.: U.S. Pat. No. 8,502,060 B2) describes a filter method which is based on a bandpass filter which is placed symmetrically around a frequency detected as maximum peak value within the recorded signal of a strike and where it is assumed that this peak value corresponds to the frequency associated with the first overtone, wherein the filter prevents frequencies falling outside the pass frequency range being shown.

The focus area determined according to the present invention differs from a bandpass filter since no frequencies are filtered out of the signal from the strike buffer. Nor does setting of the focus area in focus mode prevent the possibility of frequencies falling outside the focus area being shown. For this purpose the focus mode makes use of a magnitude manipulation operation, optionally supplemented with a magnitude filter which is set to a magnitude-manipulated strike buffer or magnitude-manipulated power spectrum thereof, of which only the mutual ratios of the frequency content has been changed, but wherein no frequencies have been removed for tone analysis, tone selection or frequency bin selection for tuning purposes. A frequency bin selection algorithm modified to be specific magnitude manipulation operation comprises specific conditions which are adjusted to this specific magnitude manipulation operation, whereby a tone suitable for tuning purposes can be detected.

When being determined, the focus area need not of course be set symmetrically with cut-off frequencies which have an equal frequency interval relative to the detected magnitude peak or a frequency related thereto.

It is perfectly well possible to determine an asymmetrical focus area relative to a determined inputted or retrieved frequency or frequency band or a detected magnitude peak or a frequency related thereto, this having a wholly different frequency interval between on the one hand the upper maximum frequency thereof and the detected magnitude peak, or a frequency related thereto, and on the other the lower minimum frequency and the detected magnitude peak or a frequency related thereto.

In this simple focus mode a focus area is in this way first defined which has a frequency band range at least partially comprising at least one of the following: an inputted frequency or frequency band, a retrieved frequency or frequency band or a detected magnitude peak associated with a frequency band or a frequency related thereto which is for instance associated with a fundamental tone or an overtone thereof, such as the first overtone. The focus area will be set at each subsequent strike when the simple focus mode is active.

At each subsequent strike, when the simple focus mode is active, a power spectrum is then calculated of the strike buffer of this subsequent strike and a search is made within the bandwidth of this focus area for the frequency band or the frequency bin within the power spectrum which has the lowest magnitude. The magnitude value associated with this frequency bin of the power spectrum is subsequently stored and optionally multiplied by a coefficient.

Within the power spectrum of the strike buffer of this subsequent strike the magnitudes of all frequencies or frequency bins associated with the frequency range not forming part of the focus area are then normalized proportionally to the stored magnitude value as maximum or limited to this value, which stored magnitude value is optionally multiplied by a coefficient.

US patent (Pub. No.: U.S. Pat. No. 8,502,060 B2) describes a tone selection method which is based on the selection of a maximum magnitude peak within a delimited frequency range with a bandwidth smaller than the overall discerned spectrum and which has an upper limit frequency and a lower limit frequency. In a possible embodiment this frequency range or this frequency band is the same as the frequency band set with the passband filter.

The focus mode as described in the present invention conversely makes use of a tone selection method which is adapted to the specific magnitude manipulation operation of the focus mode.

In a preferred embodiment a tone analysis or tone selection method is applied for tuning purposes wherein a search is made for a suitable frequency bin within the whole discerned spectrum of a strike buffer or a part of a strike buffer over the whole bandwidth of a magnitude-manipulated power spectrum. This bin can then be selected and further processing of at least the suitable frequency bin can be added as additional step. An example of an additional step can be: rounding off this value or calculating a spectral centroid frequency which is more preferably rounded off to a multiple of 0.1 Hz. A value related hereto is then regarded as detected tone and can be displayed via the user interface or stored or used for further processing.

In a preferred embodiment of a method or apparatus according to my invention a search is made within the overall bandwidth range of the discerned spectrum within the strike buffer for a magnitude peak, a frequency of which is calculated and which is deemed as detected frequency. This is different from the method or the apparatus as described in U.S. Pat. No. 8,502,060 B2, wherein only a delimited part thereof is searched for a peak value.

A more advanced focus mode consists via a further extended method of still further delimiting the focus area with magnitude threshold values and searching for magnitude peaks falling within or outside these peak values, and a search need be made not for a maximum peak but for a peak which falls within or outside the threshold values but does not correspond to a maximum peak.

In the simple focus mode a magnitude passband is preferably also defined with lower and/or upper limit values. Selection or display of frequencies or frequency ranges lying outside the magnitude passband can thus be avoided during selection of a suitable magnitude peak. It is also possible to employ only one threshold value or employ just, or more than, two threshold values so as to delimit the magnitude ranges as desired, for instance in accordance with the signal content and/or in accordance with the tone analysis or peak selection requirements.

In a further preferred embodiment determining of the focus area takes place on the basis of an assumed, known, inputted or detected location of the fundamental tone of a drum. The focus area is thus related to the fundamental tone of a drum. This focus area can be redefined here in adaptive manner when the fundamental tone of a drum changes. The fundamental tone can fall within the focus area, but need not do so.

In similar manner to the above focus methods, focus mode variants are also possible wherein a magnitudes are inverted and wherein a minimum peak is searched for or wherein the symbol is unimportant, but wherein a search is made for a peak with a determined deviation relative to a determined value or wherein a search is made in only a determined range of the overall discerned spectrum in the strike buffer for a suitable peak which lies for instance at a determined interval from a detected fundamental tone, as already described at length in this text.

It is also possible to increase the magnitudes of the frequencies or frequency bins within the focus area such that they exceed a magnitude threshold value which is for instance set such that it lies above the maximum magnitude value measured in the power spectrum outside the focus area, so that during magnitude peak detection the maximum value within the focus area is detected as maximum peak value. It is likewise possible to decrease the magnitudes of the frequencies or frequency bins within the focus area such that they fall below a magnitude threshold value which is for instance set such that it lies below the minimum magnitude value of a frequency bin situated in the power spectrum outside the focus area, so that during magnitude peak detection below a determined maximum magnitude threshold value the maximum magnitude value within the focus area is detected as maximum magnitude peak value.

All magnitude manipulation techniques which have the purpose of changing the mutual ratios of the loudness of the respective frequencies and/or of the magnitudes of the frequency bins in a power spectrum of a strike buffer fall within this invention.

These frequencies or frequency bins can comprise the whole discerned spectrum or only a part thereof, irrespective of whether these frequencies or frequency bins fall within a determined passband or a determined focus area or fall just outside it. Magnitude manipulation techniques, whereby a magnitude deviation or a magnitude ratio difference results or is created between the frequency bins which lie within a focus area and those which fall outside a focus area, so that determined frequency bins become more easily detectable via an algorithm such as a tone analysis method or a pitch detection method for tuning purposes, do of course fall within this invention.

Many alternative combinations and magnitude manipulation techniques are of course possible which are not all listed in this text.

All manipulations in the frequency domain of the frequency content of a microphone or vibration sensor signal or a signal buffer used for tone analysis for tuning purposes, or of the magnitudes of frequency bins in a power spectrum thereof, whereby their relative magnitude ratio is changed, and without frequencies being wholly removed from the signal, fall within the tuning method as discussed in this invention. These manipulations preferably take place in the frequency domain. They can however also take place in the time domain.

When the focus mode is activated the apparatus preferably shows via the user interface for each subsequent strike a value which is related to a detected tone, as well as the difference between this detected tone and a target tone.

Variants wherein the separate functional parts are split up into separate devices are also included in this invention.

It is possible in this respect to have an embodiment with a separate first device which is for instance provided with a signal input for receiving the signal from a vibration sensor or microphone part and/or wherein said vibration sensor or microphone part is integrated directly into the device, wherein the first device records an input signal and/or strike buffers and which can for instance be equipped with a clamp for mounting on an instrument or component thereof or on a stand optionally in the vicinity thereof. This first device then passes the recorded signals to a second device for processing thereof in accordance with the steps of the method described in this invention, or this first device itself processes the signals in accordance with the steps of the method described in this invention and sends a result of the processing to a second device which shows a value related to this processing via a user interface. An example hereof can be an application on a smart peripheral, software program or a piece of code installed on a computer, laptop, notebook, PDA, pad, tablet; smart phone or a smart watch or successors thereof as second device which receives data from at least one first device and processes and/or shows the data via the user interface.

In a further preferred embodiment the apparatus can also be equipped for the purpose, within a drum kit assembled by the user by creating a set of a determined number of individual drums, of calculating for all individual drums thereof a fundamental target tone on the basis of an interval which is defined by the user and which can be individually set between at least two individual drums of this drum kit, wherein a reference drum is also determined within this drum kit which has a target tone or which is assigned and against which this interval is expressed.

In this way a frequency is more preferably determined per individual skin of the drums for the ideal first overtone thereof based on multiplying the calculated, detected, inputted or selected fundamental tones by determined coefficients which are for instance determined empirically and which on the one hand can optionally also be selected by the user on the basis of indicating a preferred setting via the user interface or which can on the other be loaded via a predetermined 'target tone, coefficient or preferred setting preset' or a combination of at least two hereof, which can for instance be purchased or downloaded.

Different types of coefficient can for instance be related to different types of drum skins and be stored in for instance 'presets' which can be retrieved by the user for further processing, for instance via the user interface of the apparatus.

The user can in this way indicate which specific type of drum skin is being tuned, whereby a target tone can be calculated, or target tones can be calculated, on the basis of a coefficient which is for instance related to the specific type of drum skin or to determined physical properties thereof. The calculated target tones are more preferably stored per drum and used to calculate the difference from a detected tone.

At least one of the following data is then shown here as feedback to the user via the user interface: the detected tone, the difference between the detected tone and the target tone, the target tone.

A maximum of two of the following data are more preferably shown as feedback to the user via the user interface: the detected tone, the difference between the detected tone and the target tone, the target tone.

In yet another preferred setting the tuning apparatus or the tuning application is combined with a sales device which is provided with a shop part which is equipped to show and/or sell digital and/or physical products or services, and which products or services can be ordered or purchased by the user via the user interface of the tuning apparatus or tuning application, wherein these products or services are preferably related to musical instruments, sound effects, sound databases, accessories and prerequisites for making music, creating, recording, storing or processing sound or prerequisites for maintaining musical instruments.

In a further preferred embodiment the user can indicate one of the following data per drum via the interface: the brand and/or type of the instrument, the brand and/or type of at least one of the one or more drum skins which have been mounted or are desirably to be mounted, the brand and/or type of damping which has been mounted or is desirably to be mounted, which components of tensioning rings and the like have been used, wherein a visualization such as an image of the indicated data is preferably also shown via the user interface. This allows at least partial virtual configuration of an instrument, wherein at least partial visualization takes place. This visualization or this configuration is preferably linked in its content to the sales device provided in the tuning apparatus or the tuning application and/or to an external sales device such as for instance a web shop.

The user can more preferably log into the tuning apparatus or the tuning application with a profile linked to his/her personal entity. Personal preferred settings and preferred tunings and target tones can hereby be saved and loaded externally and different users can have their own account linked to their profile, wherein the same tuning apparatus of the same tuning application can load and/or display different personal preferred settings and preferred tunings depending on who is logged in.

The configuration data and/or preferred settings are preferably stored and managed in or outside the tuning apparatus or the tuning application for further processing. Transfer of the configuration data is possible via data transfer which can take place in wired or wireless manner.

In a preferred embodiment of the apparatus or tuning method according to this invention the target tone of the individual skins calculated on the basis of a coefficient or coefficients is not displayed. During tuning of the skin two data are then displayed as feedback via the user interface, these preferably being the detected tone on the one hand and the difference between this detected tone and the calculated target tone on the other.

Figure 1:
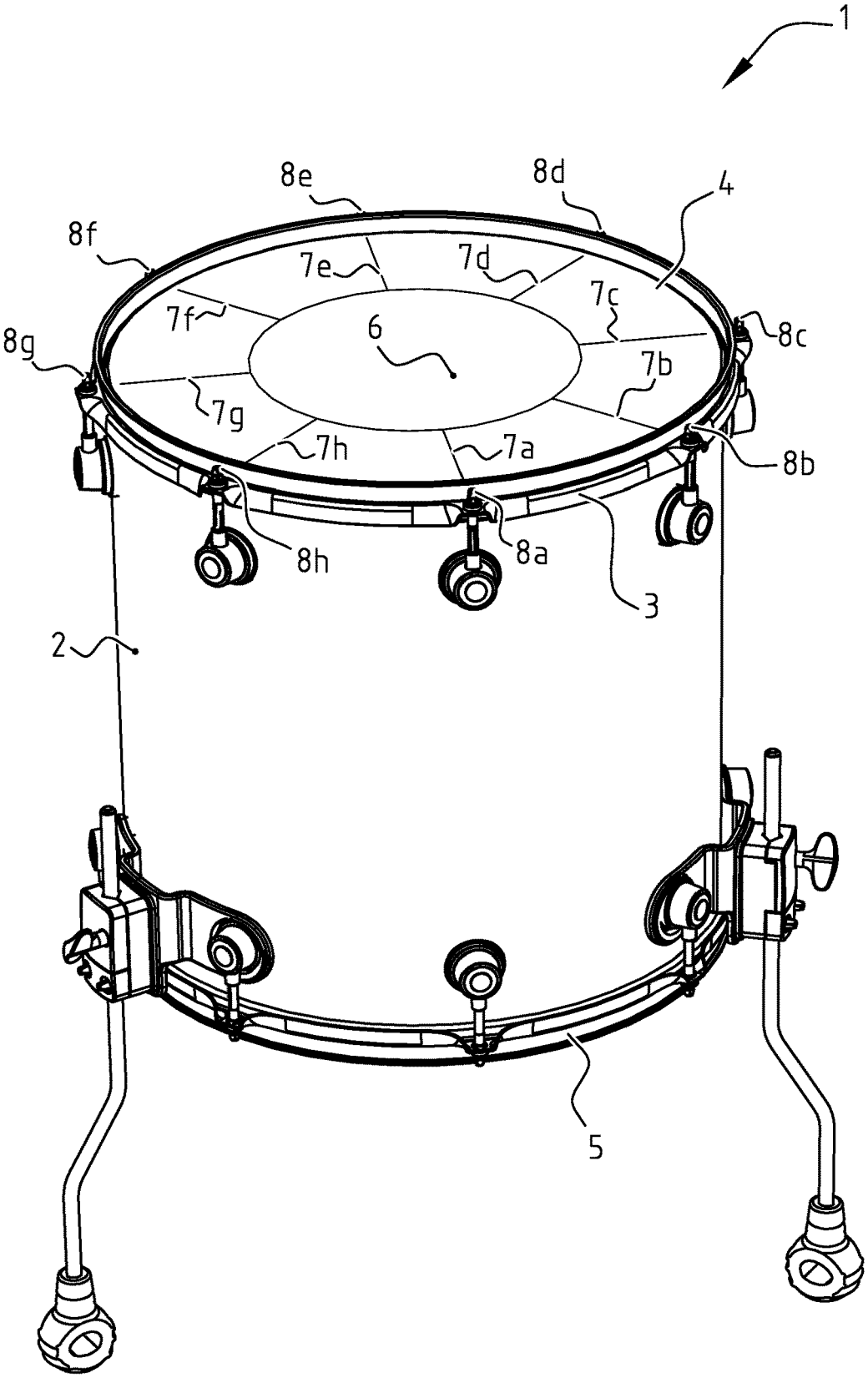
FIG. 1 illustrates a drum which can be tuned by applying the invention.

FIG. 1 shows an example of a drum 1. A drum 1 is defined as a percussion instrument with an at least partially hollow body 2. Body 2 has a cavity with at least one opening, which opening has a rim 3 and wherein a skin 4 is tensioned over rim 3. Skin 4 is a membrane which can be of natural origin or of artificial form, for instance textile, leather or plastic, although in some cases it can also be a stiff material such as wood or metal. Such skins for tensioning over an opening of a percussion instrument are known, and therefore not further elucidated in this description. Drum 1 of FIG. 1 has a cylindrical body 2 with a cavity delimited by two openings lying opposite each other with respective rims 3, 5. A skin is typically also tensioned here over rim 5 in order to close the lower opening. The lower opening can alternatively be left open. Additional examples hereof are timbale, bongos, concert toms, octobans, djembes, congas and so on. Drums can however also be formed with a bowl-like body with a cavity having only one opening. This cavity is not necessarily closed by a membrane. Idiophones are also deemed membranophones in the context of this text because the invention is suitable for analyzing the fundamental tone and the overtones thereof in similar manner. The tuning control means then consist of the physical deformation of a part of the bowl-like body itself. Cowbells and xylophone bars are an example hereof. A particular example hereof are so-called kettledrums comprising individual tuned zones which can be tuned by means of geometric deformation thereof and for which this tone detection and tuning method is suitable, but which do not comprise a membrane. Other bowl-like bodies with only one opening do however comprise a membrane. Examples hereof are timpani and tablas.

Like substantially all instruments, drums 1 provided with a tensioning system can be tuned. The sound, including the timbre, the pitch, the reverberation duration and so on can be adjusted by tuning. A drum 1 is tuned by changing the tension of skin 4. The tension of skin 4 relates to the force with which skin 4 is tensioned over rim 3 as well as to the uniformity of the tension distribution along the periphery of rim 3. While the absolute tension of skin 4 over rim 3 substantially determines the pitch of the drum, the uniformity will mainly determine the timbre and resonance of the drum.

Tuning a drum 1 in order to obtain an optimal sound is difficult, particularly for an inexperienced user. Skin 4 is typically tensioned over rim 3 of drum 1 such that rim 3 comprises a plurality of segments and wherein skin 4 can be tensioned or slackened in each of the segments by a user. A uniform tuning or uniform tension is obtained when the tension distribution close to rim 3 is the same, or approximately the same, in each of the segments. The uniformity of the tension relates to the uniformity of the distributing thereof around the periphery of the skin. A uniform tension provides for a balanced timbre across the reverberation duration or resonance of a strike on the drum.

A uniform tension is deemed as the tension of the skin at which all separate vibration frequencies of the skin, such as are present for instance as first overtone, are identical to each other or substantially identical to each other per respective rim strike close to the individual tuning control means 8.

In the example of FIG. 1 drum 1 has a plurality of lugs 8 which are connected to a ring tensioned over rim 3. Lugs 8 are also provided with tuning pegs. Each of the tuning pegs of lugs 8 can be tightened or loosened such that at the position of lug 8 the ring pulls harder or less hard on skin 4. The tension of skin 4 can thus be increased or decreased at the position of the segment of rim 3 where the associated lug is situated. The invention has for its object to provide a method and an apparatus which indicates to the user where the skin has to be tightened or slackened such that an inexperienced user can also tune a drum in optimal and uniform manner.

When a drum skin is tapped the skin vibrates. This vibration of the skin can be detected by the vibration sensors and thus generates or influences a sensor signal which is recorded by a signal acquisition setting suitable for this purpose and which can be deemed a sound fragment, which can for instance be a signal such as an analog wave form.

An analysis of the signal content of this wave form allows, among other things, examination of the spectral components present therein for tuning purposes. For this purpose the signal content has to be converted from the time domain to the frequency domain. Diverse suitable methods and algorithms known to the experienced skilled person exist for this purpose. Examples of suitable conversion methods or algorithms are, among others: algorithms of the Fourier Transformation family, such as a Fast Fourier Transformation (FFT); a Discrete Fourier Transformation (DFT); a Sparse Fourier Transformation (SFT); or a Short-Time Fourier Transformation (STFT); a Discrete Cosine Transformation or Discreet Sine Transformation (DCT) or (DST), also Fast and Discrete transformation methods forming part of the Hartley family, such as for instance FHT or DHT, fall within the possibilities; Fast and Discrete transformation methods such as the Laplace transformation, or transformations forming part of the wavelet transformation family can likewise be suitable, including for instance FWT and DWT. The invention is not however limited to these methods. Multiresolution analysis (MRA) and multiscale approximation (MSA), McAulay-Quatieri Analysis (MQ); Karhunen-Loève Transform (KLT); and also Autoregressive Spectral Analysis (AR); and so on are likewise examples of methods enabling a conversion of the signal content from the time domain to the frequency domain or tone analysis. This list is not limitative.

Following conversion of the signal content from the time domain to the frequency domain it is generally possible to obtain for instance an energy spectrum, a power spectrum or a magnitude spectrum, optionally after conditioning of the signal, filtering, windowing thereof in the time domain or in the frequency domain, from which information can be derived relating to inter alia the frequency, the magnitude, the phase of the signal as well as the energetic flux, the distribution of the spectral content, the location of the spectral centroid, the relative location of the partials and their relative magnitude ratio, and so forth. When multiple sound fragments are thus considered in a determined time period, the variations in said information types can also be considered and compared over the course of this time period. A spectral envelope can in this way be obtained which can express for instance the timbre of a strike or an instrument, whereby a picture can for instance also be formed of the dynamic progression thereof. The thus obtained data can be utilized to instruct the user about the tuning of his/her instrument and how best to adjust it.

Analysis of the spectral content of a sound fragment over a time period at the beginning of a strike on the one hand and over a time period at the end of a strike on the other gives an indication of the magnitude distribution of the partials thereof over time, wherein the first partial is the fundamental tone and the second partial corresponds to the first overtone thereof.

Comparing the information obtained from both fragments gives an indication of the frequency bands within which the fundamental tone and the first overtone thereof are situated.

As known to the skilled person, a Short Term Fourier Transform (STFT), among others, is typically suitable for determining the dynamic progression of the spectral content over a considered time period for the purpose of time resolution, and methods such as DCT, FST, DFT or FFT are typically suitable for analyses in which the time resolution is less important than the frequency resolution, although as stated above many other methods are suitable.

Tests have shown that the ratio between the amplitudes of the available partials, such as the ratio between the amplitude of the fundamental tone and the amplitude of the first overtone, is different at the beginning of a sound fragment comprising the whole duration of the resonance of a strike than at the end thereof. In the case of a drum with two skins the fundamental tone typically has a more prominent presence compared to the amplitude of the first overtone at the beginning of a strike than at the end of this same strike. This is because when a skin vibrates the vibration mode of the fundamental tone retains energy for a shorter time compared to the vibration mode of the first overtone because the vibration mode of the fundamental tone produces sound in a more efficient manner. Further tests have moreover indicated here that in a microphone sound fragment of a drum stroke, typically the amplitude peaks present in the frequency range lying between the fundamental tone and the first overtone thereof are noticeably less pronounced compared to the fundamental tone and the first overtone thereof than the amplitude peaks present in the area following the first overtone, so the range in which the overtones of a higher order are situated. This is because, the higher the overtones are in the frequency spectrum, the closer together they are.

This insight allows a further refinement of the tuning method of this invention so that the filter can be determined in an even more robust manner.

In the case of a center strike an indication of the location of the first overtone frequency range can thus preferably be obtained by analysis in the frequency domain of a final fragment or part thereof over time, while a fundamental tone frequency range is preferably determined by analysis in the frequency domain of a first fragment or part thereof over time. Analysis of the frequency content of a sound fragment from a strike on a specific drum in the time domain enables the filter to be adjusted on the basis of a predetermined algorithm which also takes into account the thus determined fundamental tone frequency range without the exact fundamental tone frequency within this determined fundamental tone frequency range being known.

The filter is in this way adjusted in an adaptive manner on the basis of a predetermined algorithm, here likewise taking account of the spectral content of a center strike, whereby for each further strike on the same drum the filter can be applied with increased operational certainty. The filter is thus adjusted adaptively to a specific drum with determined tuning.

By verifying the location of the fundamental tone within a determined fundamental tone frequency band in the sound fragment of a further strike, wherein the location of the fundamental tone in this further strike is compared to the location thereof as previously determined during a first strike, the pass frequency of the filter can be modified adaptively when the position of the fundamental tone shifts as a result of the skin being retuned without another center strike being necessary for this purpose. This verification and filter calibration step is preferably applied at each further strike and has the advantage that the filter adjustment is adaptive to the operation of tuning. This improves the robustness of the filter, since the adjustment thereof is calibrated during the course of the tuning process according to the steps of the method of the invention.

It is alternatively also possible to analyze the sound fragment in the time domain in order to obtain determined frequency information, optionally after conditioning, filtering, smoothing of the signal and so on. By measuring the duration of the first cycle of the wave form in the time domain the period of the most dominant frequency in the sound fragment can for instance be estimated in order to thus obtain an indication about the frequency thereof. While this method does not result in the accurate determination of the fundamental tone frequency in the case of a central strike, and so cannot be used for accurate tuning purposes, this method does however provide the option of determining a frequency range within which the fundamental tone is probably located. This knowledge can then be used in the detection of the fundamental tone frequency in the sound fragment. It is for instance alternatively possible in the time domain to count the number of peaks or count zero point crossovers of the waveform within this sound fragment of a detected strike within a determined time period in order to obtain an approximate indication of the most dominant frequency present in the specific sound fragment during the time period under consideration.

A fundamental tone frequency range obtained in this way can be situated around the frequency obtained from analysis of a first fragment of a center strike in the time domain. Allowance is made here in the determination of the width of the fundamental tone frequency range for a certain degree of inaccuracy which is characteristic of the frequency determination methods in the time domain applied for a strike on a drum. In a sound fragment of an undamped center strike the fundamental tone frequency is however typically the most dominant frequency in the frequency spectrum. Particularly in the case of a center strike this method can result in a sufficiently accurate indication of a fundamental tone frequency range within which the fundamental tone is probably located, in order for instance to enable the filter setting to be determined on the basis of the thus found fundamental tone frequency range or a thus determined fundamental tone frequency. In general terms an analysis of the sound fragment in the time domain in the manner as described above allows the approximate frequency of the fundamental tone to be known, and thus at least an indication of the fundamental tone frequency range to be obtained within which the fundamental tone is probably situated, so that the filter setting for the overtone can be determined at least on this basis. According to the method of the invention, for the step in which the determination of a fundamental tone takes place, the conversion of the time signal to the frequency domain can in this respect also be interpreted as a step in which at least a fundamental tone frequency range is determined in the time domain. A fundamental tone frequency range or a fundamental tone frequency can thus be determined here on the basis of analyzing the sound fragment of a strike in the time domain, and this range can be used according to the method of this invention to determine an overtone frequency range of a determined overtone as pass frequency range of a filter within which the determined overtone can be detected.

For this purpose a modified preprocessing step or conditioning step of the signal content is preferably performed wherein for instance high or other superfluous frequency content in the signal is filtered out and/or wherein the signal is smoothed, in order to obtain a more reliable indication of a fundamental tone frequency range. Smoothing takes place by way of example by applying a convolution-based filter function, such as a Savitszky-Golay filter, because this technique does not distort the overtones and fundamental tone in disruptive manner for the purpose of determination thereof on the basis of the smoothed signal. An overtone filter setting can subsequently be determined in the same manner according to the invention on the basis of the fundamental tone frequency range determined in the time domain or the fundamental tone frequency determined in the time domain, whereby at each further strike a predetermined overtone is detectable within the pass range of the thus determined filter.

For a more precise determination of the fundamental tone frequency of a strike on a drum the frequency domain can for instance be searched for instance for a suitable spectral peak in order to determine a fundamental tone frequency, although other tone determining methods are also suitable for this purpose. Irrespective of whether the fundamental tone is determined in a sound fragment in the time domain or in the frequency domain, a pass frequency range can be set on the basis of a determined fundamental tone frequency or fundamental tone frequency range in accordance with the method of this invention.

The invention is based on the insight, among others, that a center strike and an edge strike on skin 4 of drum 1 comprise different information, as will be further elucidated below, which different information can be correlated to each other during tuning. The information content of a center strike or an edge strike is also different over the reverberation duration thereof, this also providing for further correlation options. A center strike on skin 4 of drum 1 is defined as a strike on the central zone of the skin, designated in the figure with reference numeral 6. Central zone 6 can further be specified here as the circular zone with the center of skin 4 as center point, wherein the circular zone has a radius which is half the average radius of the opening with rim 3 over which skin 4 is tensioned. An edge strike is defined as a strike close to rim 3. A strike close to rim 3 can further be specified as a strike outside central zone 6 as defined above. An edge strike is preferably specified as a strike within the zone 11, wherein the radius is about 5 cm less than the average radius of the opening with rim 3. Typical of an edge strike is that a segment of rim 3 can in each case be designated to which the edge strike is most closely adjacent. In the figure the designations 7*a*, 7*b*, . . . , 7*h* are illustrative of zones of edge strikes adjacent in the example of FIG. 1 to corresponding lugs 8 with tuning pegs with which the tension of skin 4 can be adjusted as described above.

In the case of a drum 1 with a plurality of skins the lower skin is preferably not damped at the position of lower rim 5 during a center strike, while the lower skin is damped at the position of second rim 5 during an edge strike. Damping of the lower skin at the position of rim 5 is defined here as mechanically preventing vibration of the lower skin and/or the underlying air mass at the position of second rim 5. This is possible for instance by pressing a hand of the user against the skin, placing the instrument on a surface whereby the free movement of the air mass close to the skin is prevented or by laying drum 1 on a soft object such as a cushion when the second skin must be damped at the position of rim 5. By not damping the second skin during the center strike and damping the second skin during an edge strike the information from the respective center strike and edge strike will be less complex and more easily processable for use in the method described below. Notwithstanding that damping of a skin during an edge strike will be more easily processable for use purposes, the tuning method as described in this text is specifically suitable for successful analysis of the first overtone during an edge strike without any damping of the second skin, since the filter as determined on the basis of a first sound fragment of a center strike makes it possible to successfully determine the first overtones of the skins during a second edge strike without skins having to be damped for this purpose.

In a sound fragment of an undamped center strike the most dominant frequency is typically the fundamental tone frequency. An analysis of the sound fragment in the time domain as described above allows the frequency of the fundamental tone to be approximately known in order to thus obtain an indication of the frequency range within which the fundamental tone is probably situated.

When the information obtained by analyzing a sound fragment within the time domain is combined with the information obtained by analyzing the same sound fragment within the frequency domain, areas can be delimited in a robust manner within which it is highly probably necessary to search for a determined fundamental tone or a determined overtone, such as for instance the first overtone.

The precise location of the fundamental tone and the first overtone thereof within the same sound fragment, or within different sound fragments of strikes on a skin of the same drum, can hereby be determined with greater certainty without these having to be the most dominant frequencies within the considered fragment. This allows accurate detection of the first overtone and the fundamental tone without these having to be the greatest peak within the magnitude spectrum.

The method and the device or apparatus according to the invention preferably comprise a user interface which gives instructions to the user about respectively center strike and edge strike when these are requested during performing of the method. When the method requires a center strike as input, the user interface can thus give the user instructions for performing a center strike, wherein the instructions can relate to the location where the user must tap on skin 4 as well as to not damping the lower skin at the position of second rim 5. When the method requires an edge strike, the method can also comprise of instructing a user via a user interface about the position where the user must tap on skin 4 as well as about damping the lower skin at the position of second rim 5. By giving these instructions to the user via the user interface even an inexperienced user will be capable of optimum tuning of a drum, and the susceptibility to error of the method described below will be minimized. In a preferred embodiment the latter instruction is not essential here. Notwithstanding the fact that the robustness of the operation can be optimized still further by the damping, damping of a skin will often be perceived by an experienced user as being inconvenient or impractical because this operation requires more effort and makes the tuning process more time-consuming. In an alternative preferred embodiment aimed at more experienced users, showing this latter instruction is therefore not essential. Not having to damp a skin thus results in an increased user convenience during tuning.

The part of the user interface which provides the user with instructions as described above, and which possibly also supplies other information and feedback, is deemed the information output part of the user interface. It will be apparent here that it is possible to inform the user in different ways. Via for instance a display the user can be further informed by means of, among others, digits, numbers, letters, words, symbols, pictograms, color variations and so forth about the tension of the skin and/or the hardness of a strike. LEDs, for instance in multiple colors or at multiple positions, can alternatively be used to inform the user about the tension of the skin and/or the hardness of a strike. As further alternative a sound signal can be used to give the user information relating for instance to the detected pitch and/or the hardness of a detected strike. The manner in which the user is informed is not limited according to this invention to the above examples.

According to the invention the user interface preferably also comprises an information input part which is equipped with provisions with which a user can manipulate settings of the device or the apparatus, such as for instance controllers, bottoms, a touchscreen, switches, controls and so forth. Via the information input part of the user interface the user can him/herself indicate, as alternative to the above description in which the interface automatically indicates to the user which type of strike is required, whether he or she wishes to give an edge strike or a center strike on the skin, wherein the associated steps of the method can be correctly performed. Via the information input part of the interface a user can for instance further also indicate, among other things, whether a determined target overtone is desired, select or input a tone, indicate whether a determined display mode is desired, set variables, retrieve a determined user setting, retrieve or disable a determined functionality of the apparatus according to the invention, operate functions, navigate through menus and so on.

Tests have shown that the spectral content of a strike on a drum depends on the hardness of the strike, wherein the frequency of for instance the fundamental tone varies with the strike hardness. The same tests have also shown that the strike hardness can affect the location of the maximum amplitude peak of the fundamental tone or an overtone. It is found here that a drum can better be tuned uniformly when all considered sound fragments are of a similar strike hardness. It is therefore useful for a user to receive feedback about the hardness of a performed strike during performing of the steps according to the method of the invention in order to obtain a uniform tension.

To this end the user, for instance during triggering of a strike, is informed on the basis of the considered sound fragment of the strike or a part thereof about the strike hardness of the detected strike, wherein an indication of the strike hardness is preferably given via the user interface.

The user is more preferably additionally informed per detected strike about the measured strike hardness or for instance about the difference between the measured strike hardness and a determined target strike hardness which for instance corresponds to an ideal strike hardness. This has the advantage that the user can him/herself modify the strike hardness at each further strike so that a more constant strike hardness of separate strikes on a skin can be obtained so that tuning can take place efficiently and consistently. The strike hardness can be shown in any random manner, such as a dB value, a number, a designation on a scale division and so forth. The quantity is of minor importance here.

The use of velocity values, as is usual in the MIDI protocol, is an example of a suitable way of reproducing and communicating the hardness of a strike in a simple manner. An impact location can for instance also be expressed and communicated on the basis of the MIDI protocol. A sound file related to the MIDI information can be played back here via the information output part of the user interface. Drum emulation software or other sound output functionalities can for instance be controlled in similar manner on the basis of the MIDI information obtained about at least the hardness of a detected strike.

Figure 2:
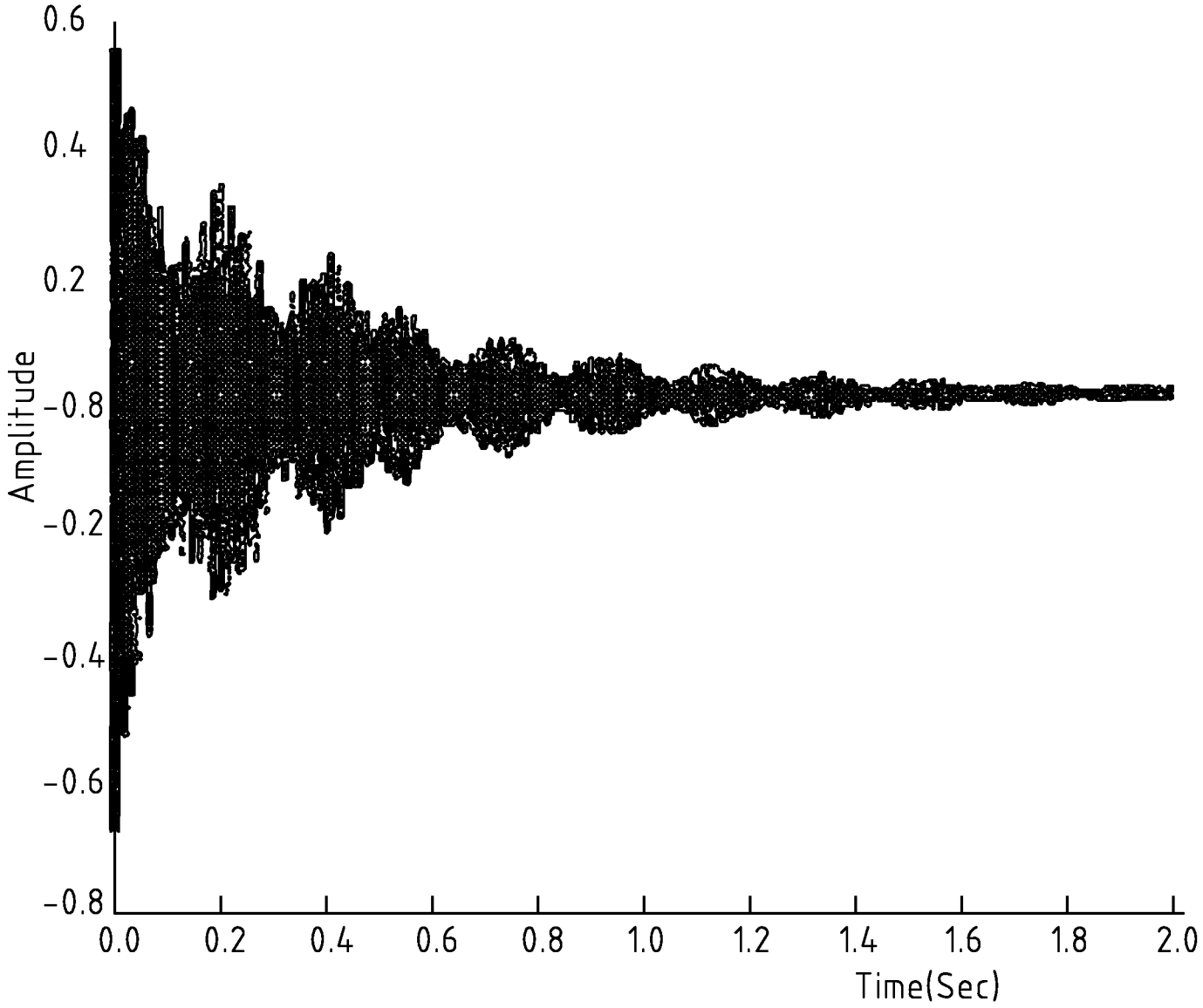
FIG. 2 illustrates a sound fragment of a strike on the drum.

FIG. 2 shows an example of a sound fragment 9 in the case of a strike on skin 4 of drum 1. In contrast to most musical instruments, such as stringed and wind instruments, a drum displays in the case of a strike a sound progression which begins with a relatively high amplitude, which amplitude then decreases substantially exponentially, whereby the period of time for which relevant information about the strike can be collected is limited. In practice a sound recording of about one and a half seconds will be more than sufficient to record the relevant sound information of the strike. After about one and a half seconds the sound level of the strike will have decreased so strongly in amplitude that ambient sounds could become dominant in a further sound recording. It will be apparent to the skilled person here that the length of sound fragment 9 of the strike also depends on the properties of drum 1. Kettledrums for instance, which typically have a relatively large skin 4 with a relatively low average tension, will thus produce a sound which extends over a significantly longer period of time than if the drum is a snare drum of relatively small diameter and wherein the skin has a high average tension. FIG. 2 shows the sound fragment in the time domain, i.e. time is shown on the horizontal axis while the amplitude is shown on the vertical axis.

Figure 3:
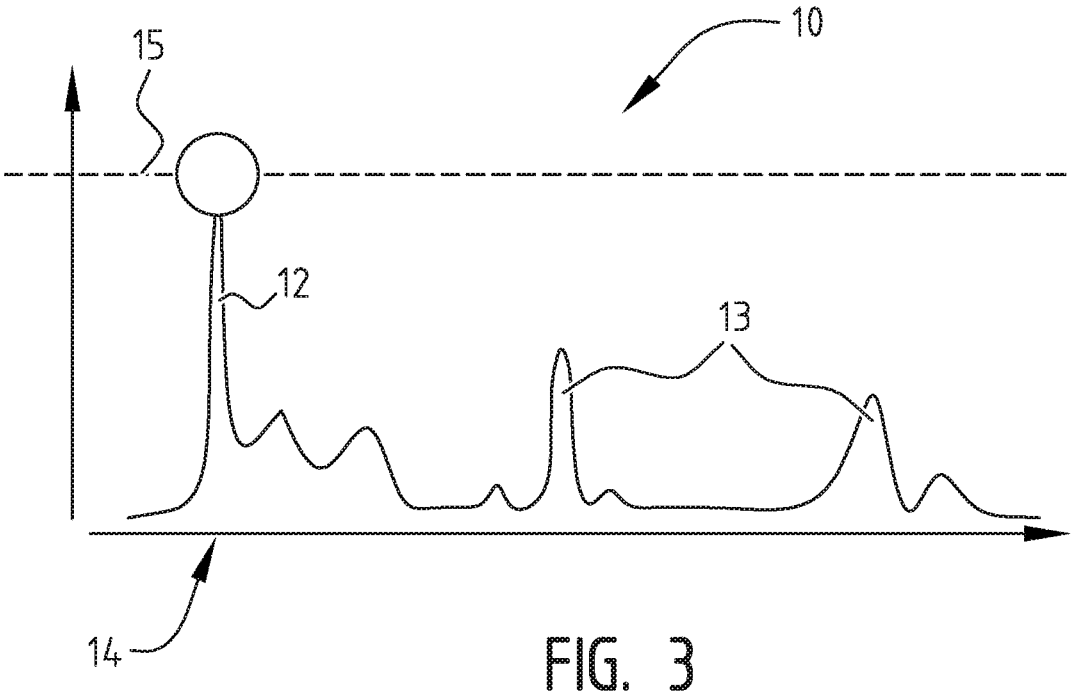
FIG. 3 illustrates a graph of a sound fragment of a strike in the center of a drumhead, converted to the frequency domain.

FIG. 3 shows a sound fragment similar to the sound fragment of FIG. 2, but shown in the frequency domain. That is, not time but frequency is shown on the horizontal axis while the amplitude is shown on the vertical axis. FIG. 3 is deemed to be a representation of a power spectrum wherein an indication is shown of the amount of energy per frequency as present in the considered sound fragment. This can be an optionally normalized representation. FIG. 3 hereby shows in relatively simple manner the frequencies which are dominant in a sound fragment. Conversion of a sound fragment from the time domain to the frequency domain is known, and this conversion is therefore not discussed in further detail in this description. An example of conversion from the time domain to the frequency domain is a Fast Fourier Transformation (FFT).

Figure 4:
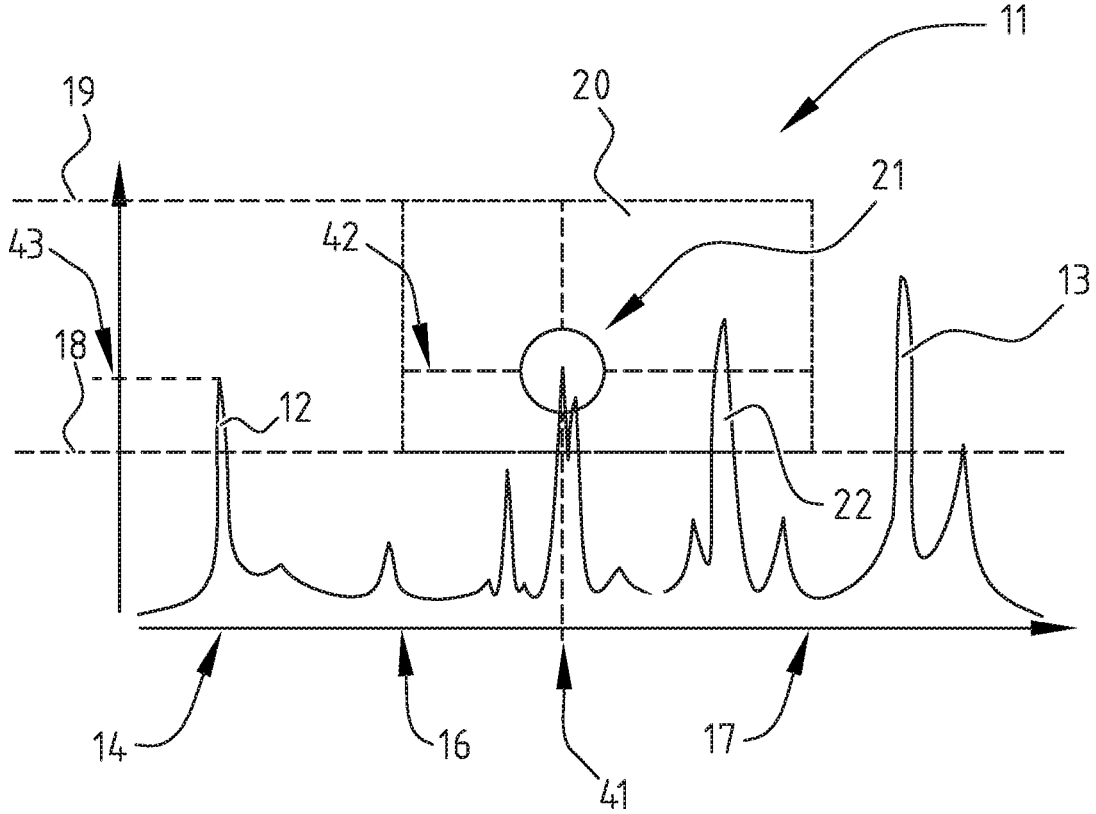
FIG. 4 illustrates a graph of sound fragments of a strike nearby the edge of a drumhead, converted to the frequency domain.

FIG. 4 shows a sound fragment similar to FIG. 3, but it represent the signal content of a different strike on the drum, shown in the frequency domain. The sound fragments as shown in FIG. 3 and in FIG. 4 were converted from the time domain to the frequency domain wherein the figures are a representation of a power spectrum, although this could also be referred to on occasion as frequency spectrum, spectrum, power spectral density (PSD), magnitude spectrum and so on. This can for instance be obtained by means of Discrete Fourier Transformation (DFT), although other techniques, including for instance a deconvolution algorithm such as the Maximum Entropy Method (MEM), are also suitable for this purpose. These techniques are generally known to a skilled person and the manner in which this takes place is further of minor importance.

FIG. 3 and FIG. 4 illustrate the difference in information in the case of a center strike and an edge strike. FIG. 3 here shows a sound fragment of a center strike 10 while FIG. 4 shows a sound fragment of an edge strike 11. Characteristic of a sound fragment of a center strike 10 is that fundamental tone 12 substantially always has a dominant presence. That is, fundamental tone 12 has a notably greater amplitude peak of 15 in the frequency domain than overtones 13. The fundamental tone 12 and associated fundamental tone frequency 14 are therefore easy to detect from such a sound fragment 10. When fundamental tone 12 is detected, both fundamental tone frequency 14 and fundamental tone amplitude 15 will also be determined.

FIG. 4 shows a sound fragment of an edge strike 11. Typical of a sound fragment of an edge strike 11 is that fundamental tone 12 has a notably less dominant presence than in the case of a center strike 10. Overtones 13, including first overtone 21 and second overtone 22, will conversely have a strong presence.

Other than in the case of a center strike wherein the overtones typically have a weak presence in the sound fragment, it is however possible in the case of an edge strike that fundamental tone 12 has a strong presence in a sound fragment of the edge strike. Characteristic of a sound fragment of an edge strike is that the overtones usually have a more prominent presents relative to the fundamental tone. It is however possible here that the first overtone does not have such a dominant presence that it has the greatest amplitude peak in the frequency spectrum. In practice either the first overtone 21 or an overtone 22 of a higher order, or even fundamental tone 12, can have a dominant presence in the spectrum of a sound fragment of an edge strike wherein none of the skins are damped.

Tests have shown that the tuning of drum takes place best on the basis of first overtone 21. Recent studies relating to the frequencies of sound fragments of center strikes 10 and edge strikes 11 of drums have made clear that the frequencies of the ideal first overtone can be calculated on the basis of the frequency of fundamental tone 12.

The method according to the invention therefore comprises of first determining the fundamental tone frequency 14 and the fundamental tone amplitude 15 following a center strike. On the basis of this fundamental tone frequency 14 and the fundamental tone amplitude 15 a calculation is then made by means of a predetermined algorithm of the frequency range of first overtone 21, and the overtone amplitude range, which has a determined amplitude range 18, 19 within which the amplitude 42 of this first overtone 21 is situated. The method likewise comprises of placing a filter with a pass frequency band between 16, 17 comprising the calculated first overtone frequency range which is most likely to comprise first overtone 21. In FIG. 4 the pass frequency band lies between frequency 16 and frequency 17. As shown, first overtone 21 need not necessarily lie centrally in pass frequency band 16, 17. The pass frequency band is selected such that at a further strike there is a maximum chance of the first overtone falling within pass frequency band 16, 17. This allows for easy detection of first overtone 21 and determining of a frequency of first overtone 41 at a further strike. An amplitude range is preferably also calculated on the basis of the fundamental tone amplitude 50. In FIG. 4 the amplitude range is designated as the range between amplitude 18 and amplitude 19. The amplitude range between amplitude 18 and amplitude 19 is preferably scaled adaptively at a further strike in proportion to the measured amplitude 43 of the fundamental tone frequency 14 in this further strike. Defining an amplitude range further improves the accuracy in detecting first overtone 21 in a further strike.

The fundamental tone frequency 14 is determined for instance on the basis of a spectral centroid of a limited frequency band comprising the greatest amplitude peak of fundamental tone 12.

Following the center strike a filter will be placed at each edge strike in order to detect first overtone 21 within the pass frequency band thereof. The filter preferably comprises the pass frequency band filter and a filter for delimiting the amplitude range. FIG. 4 shows the filter as area 20. As shown in FIG. 4, it is possible that multiple overtones 13 are visible in the filtered area 20. Both first overtone 21 and second overtone 22 thus fall within area 20 in FIG. 4. Because in the method according to the invention a particular search is made for first overtone 21, the method can be provided with logic in order to select within area 20 the amplitude peak 21 which has the lowest frequency. This further improves the correct operation of the method and the apparatus according to the invention.

The frequency of first overtone 41 detected in area 20 after an edge strike 11 is compared to the calculated overtone frequency which is based on the fundamental tone frequency 14 detected during a center strike 20. When the detected first overtone frequency 41 is lower than the calculated first overtone frequency, the user will be informed via the user interface that skin 4 must be tensioned at the position of the associated edge strike. When the detected first overtone frequency 41 is higher than the calculated overtone frequency, the user will be informed via the user interface that skin 4 must be slackened at the position of the edge strike. When the detected frequency 41 of the first overtone is roughly the same as the calculated first overtone frequency, the user can be informed that the tension of the skin at the position of the edge strike is optimal. Via a display the user can be informed by means of words and/or pictograms about the tension of the skin. LEDs, for instance in multiple colors or at multiple positions, can alternatively be used to inform the user about the tension of the skin. As further alternative a sound signal can be used to inform the user. First overtone frequency 41 is preferably determined on the basis of a spectral centroid of a limited frequency band comprising the maximum amplitude peak of first overtone 21. Other methods are also suitable for this purpose.

Figure 5:
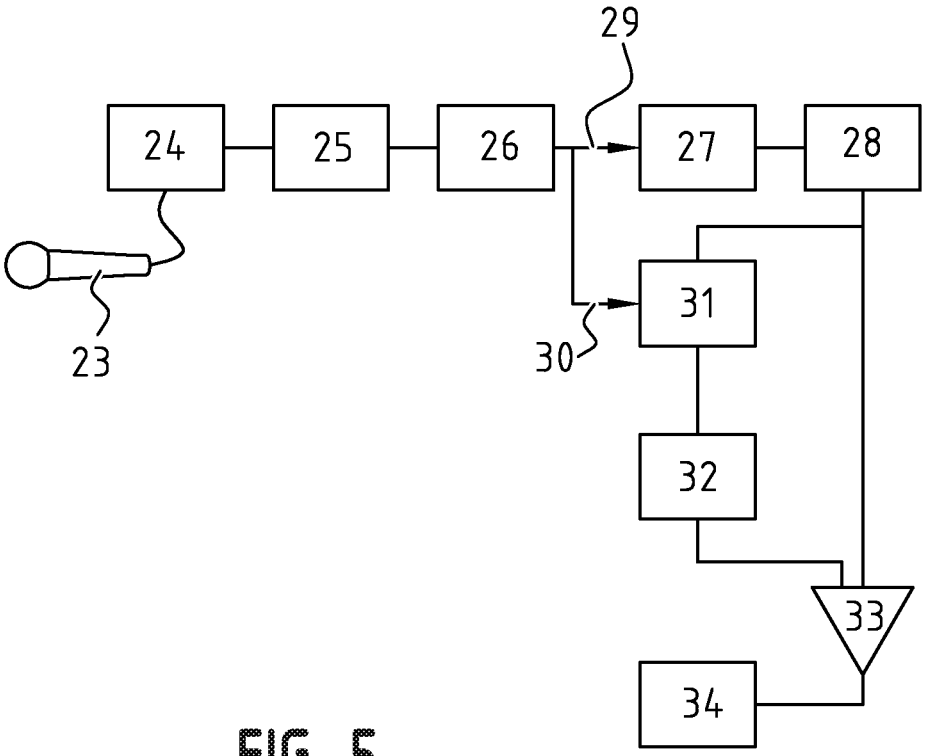
FIG. 5 shows a diagram of the method according to an embodiment of the invention.

FIG. 5 shows in a block diagram the different steps of the method according to the invention. The method begins with recording a sound fragment. Used for this purpose is a trigger method 24 which has a sound recording device 23 as input. An example of a trigger method is setting an amplitude threshold value. An amplitude threshold value has as result that, when the amplitude of the incoming signal from sound sensor 23 is higher than the threshold value, a sound recording is triggered. Recording of the sound fragment is represented in FIG. 5 by block 25. Trigger method 24 is set up such that a strike can be detected within the sensor signal in for instance the time domain or in the frequency domain, or even in a combination of the two, in order to arrive at a robust strike detection. In a trigger method 24 an event and/or point in time or time period is typically detected when at least one threshold value is exceeded which is set to a signal characteristic of a sound fragment, sensor signal or a part thereof, wherein individual samples or samples collected in buffers or derivatives of buffers are for instance considered. Such a detected event is then an onset event and related to a detection of a strike. The selection of peaks within a signal in order to determine an onset event is a generally known technique. As alternative to peak selection, the exceeding of threshold value is a generally known technique for detecting an onset event related to a strike. A threshold value can be set in the time domain or the frequency domain, or even in the complex domain. Detection of variations which exceed threshold value in the energetic flux or the spectral flux of at least one frequency band of a sensor signal in the frequency domain over a determined time period is a generally known technique. Other techniques relate to detection of amplitude threshold value being exceeded within the time domain. Considering a phase deviation is also a known technique for detecting a strike in the frequency domain. A detected strike can be regarded as an onset event which triggers a subsequent step. The advantage of detecting a strike in the frequency domain is that trigger method 24 can be specifically adapted so as to enable the acoustic characteristics of a strike on a considered drum to be distinguished from possible ambient sounds or even possible strikes on other drums, whereby robust strike detection is possible. For reasons of this robustness strike detection via trigger method 24 preferably takes place in the frequency domain. It will be apparent that other trigger methods 24 can also be applied.

A trigger method 24 has the purpose of detecting a strike within the sensor signal from sound sensor 23. Multiple amplitude threshold values, for instance related to the spectral flux, energetic flux or the signal strength within multiple frequency ranges or frequency bands, can alternatively be employed to detect a strike on the basis of a trigger method 24. An amplitude threshold value is preferably scaled in proportion to a considered ambient sound level. This scaling or adjustment can take place in a calibration step, for instance at the beginning of the tuning process. The advantage of adjusting the amplitude threshold value or values in relation to a considered ambient sound level, wherein the set threshold value or values is or are typically higher than an average amplitude value of the ambient sound over a time period or a peak value thereof, has the advantage of greatly reducing or even precluding the chance of sounds other than those originating from a strike, such as ambient sounds, being deemed as a strike by trigger method 24.

The duration of the recording as performed in block 25 can for instance on the one hand be determined beforehand on the basis of a duration setting which defines a chosen time period or on the other hand depend on the amplitude progression over the reverberation duration of the strike as discerned by trigger method 24. Trigger method 24 can for this purpose for instance determine that the recording of a sound fragment in block 25 begins when an amplitude level in the time domain, or the energy level in the frequency domain over a time period, rises above a threshold value. Trigger method 24 can then for instance determine that the recording of a sound fragment in block 25 ends when an amplitude level or energy level falls below a threshold value. There is hereby a maximum probability of the whole duration of the strike being recorded in the sound fragment, and the spectral content of the sound fragment is related as closely as possible to the considered strike. When a predetermined duration setting is employed, it could be that the defined time period is too short to be able to record the whole reverberation duration of a strike, so that perhaps insufficient information is recorded if it is too long, and it is possible that ambient sound brings about a disruptive distortion of the spectral content of the sound fragment.

A preferred embodiment of trigger method 24 can further also comprise a step for determining the hardness of a strike. This could take place by way of example on the basis of a maximum amplitude peak which is detected in the time domain or within a determined frequency range thereof. The amount of spectral energy can be measured in other manner in order to determine the strike hardness in the frequency domain. The determination of the strike hardness can alternatively take place on the basis of the information available in the sound fragment, or a part thereof, recorded in step 25 in the time domain or frequency domain. It is further of minor importance according to the method of this invention which technique or method is used to determine the hardness of a strike.

In yet another preferred embodiment trigger method 24 can likewise comprise a step for determining the impact location of a strike. This can take place by way of example on the basis of the distribution and the progression of the spectral content detected in the frequency domain over a determined time period. The spectral content could be considered over the whole spectrum or within a determined frequency range thereof. Acoustic envelopes can also be utilized in the frequency and/or the time domain which define acoustic characteristics of strikes related to determined impact locations. One or more acoustic envelopes can for instance be utilized which are each related to their own frequency range in order to obtain from their content an acoustic signature which comprises the acoustic characteristics of a determined strike which is for instance related to an impact location on a determined drum. These acoustic signatures are preferably stored per impact location and per drum. During triggering in step 24 the spectral information and the acoustic characteristics of a detected strike can hereby be compared to these stored acoustic signatures in order to check with which stored acoustic signature the acoustic characteristics of the detected strike sufficiently correspond to be able to decide where the impact location of the strike is. These acoustic envelopes can be determined in a calibration step on the basis of calibration strikes at different impact locations, so that per impact location an acoustic signature is obtained which can be stored and which for instance defines relevant spectral content, acoustic envelopes and the other acoustic characteristics of for instance an edge strike, a center strike, a kettle strike, a hoop strike and so forth on a determined drum with a determined tuning. By comparing the acoustic characteristics of a further detected strike to the stored envelopes obtained from the calibration strikes it is hereby possible to determine whether the further strike is for instance an edge strike, a center strike, a kettle strike, a hoop strike and so forth on a determined drum. A determined information output, such as a visual indication of the impact location on a symbolic representation of a skin or a drum, playback of a sound related thereto and so on, can be coupled via the user interface to the detected strike location. The user can also be informed about the consistency of the location of different strikes on a skin for practice purposes or tuning purposes and so forth.

When vibration sensor 23 comprises a plurality of sensors, such as for instance at least one microphone and a piezo-transducer, it is possible to determine in trigger method 24 by means of time difference of arrival of the individual sensor signals what the impact location of a detected strike is, optionally combined with the detection of acoustic signatures. The sensor signal of the piezo-transducer can for instance also be used to detect an onset event and/or the strike hardness prior to the consideration of the sensor signals from the microphone or microphones in order to determine the impact location and/or strike hardness. It is further of minor importance according to the method of this invention which technique or method is used to determine the impact location of a strike.

The use of channel values, as is usual in the MIDI protocol, is an example of a suitable way of reproducing and communicating the impact location of a strike in a simple manner. Each impact location is then assigned its own MIDI channel. A sound file related to the MIDI channel value can be played back here via the information output part of the user interface. Drum emulation software or other sound output functionalities can for instance be controlled in similar manner on the basis of the MIDI information obtained about at least the hardness of a detected strike.

As further alternative the sensor signal from microphone 23 can be used to distort a sound via spectral modelling techniques.

As sound recording device 23 a microphone can on the one hand be used, although other types of vibration sensor can on the other hand also be used, such as for instance vibration sensors which are arranged physically on skin 4 of drum 1 and can generate or influence an electrical signal when drum 4 is played. In this respect the following sensor types can be regarded as vibration sensors 23 in this invention, without being limited thereto: optomechanical sensors, optical sensors, mechanical distance meters, acceleration sensors, inductive sensors, transducers, capacitive sensors and so on. Likewise included here as vibration sensor 23 are sensors which are indirectly in mechanical contact via a medium with skin 4, such as piezo-transducers which are mechanically connected to the skin or the instrument via a vibration-absorbing material, such as for instance a foam, elastomer, rubber or felt, or sensors which are in direct mechanical contact with skin 4 or the instrument, such as piezo-transducers, electret transducers, PVF film, accelerometers, MEMS sensors, contact microphones. Contactless recording devices such as for instance optical sensors, such as laser vibrometers, IR sensors, NIR sensors, which are not mechanically connected to skin 4, are also deemed to be a sound recording device 23 according to the method of this invention. The use of optical sensor types as vibration sensor 23 has the advantage that triggering on the basis of a strike is not influenced, or less so, by ambient sound and that ambient sound is likewise not present, or less so, in the sound fragment obtained from the sensor signal from such a vibration sense 23. Applications of HALL sensors or capacitive sensors, wherein only a part of the sensor is in contact with skin 4, are likewise included in the invention. More specifically, applications wherein only a part of a sensor or sensors is in direct contact with or arranged on skin 4, whereby the relevant sensor part or sensor parts influences or influence the sensor signal statically or dynamically when skin 4 moves, such as for instance an electrically conductive layer which functions as capacitor plate which is arranged on the skin and vibrates relative to another capacitor plate or coil arranged elsewhere, fall within the invention and are deemed as vibration sensors 23 within the context of the invention. Likewise included here as vibration sensor 23 according to the invention are sensors arranged physically on skin 4, such as for instance; laminated sensors, transferred sensors, adhered sensors, welded sensors and so on.

Figure 6:
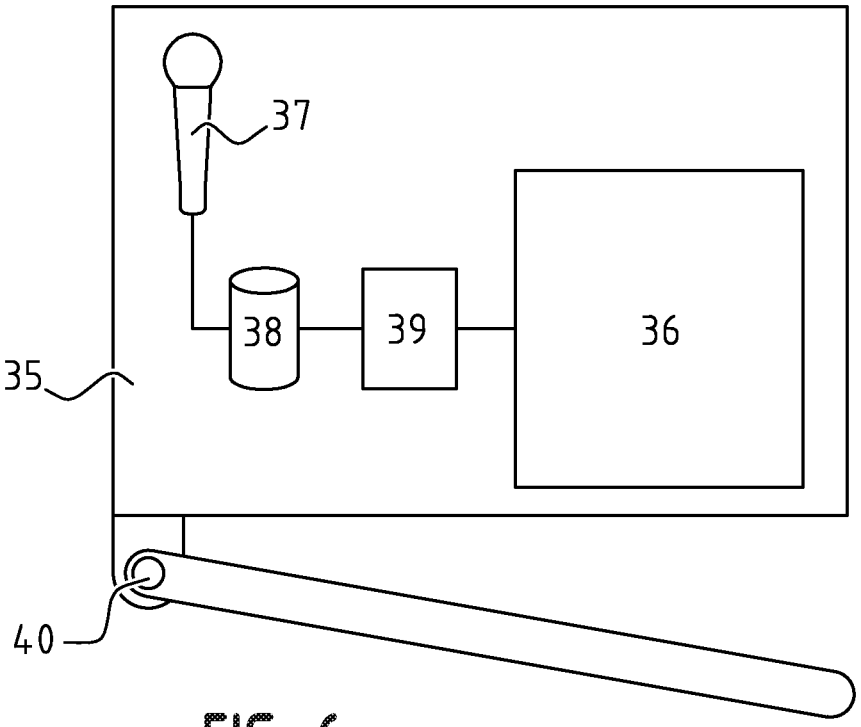
FIG. 6 shows an apparatus for tuning a drum.

Also regarded as vibration sensors 23, sometimes also referred to as sound recording device 23, are sensors which are arranged directly on a layer of a skin 4, such as: laminated, coated or printed sensors, including: inductive sensors, magnetic sensors, piezo-electric sensors, piezo-resistive sensors, resistive sensors, capacitive sensors, strain sensors such as strain gauges, interdigital capacitors or plate capacitors and so on. Examples of these types of sensor are described in PCT application (Pub. NO.: WO 2012/122608 A1) as shown in FIG. 6, wherein the sensors are designated with reference numerals **54*a*-54*h*. The use of other sensor types as sound recording device 23 is however not precluded from the invention. Within the scope of this invention an application is therefore not necessarily limited to a single sensor as vibration sensor 23. The individual sensor signals from multiple vibration sensors 23 can also be considered, wherein these may or may not all originate from a strike on the same skin 4. In such an application the considered sound fragments from multiple sensors can be processed together, simultaneously or separately according to the method of this invention. Sound recording device 23 preferably comprises one or more sound sensors, such as a microphone or a plurality of microphones. Vibration sensor 23 can for instance also consist of a combination of multiple sensors of different types, such as the combination of a piezo-transducer and a microphone. The sensor signal from the piezo-transducer is for instance used here for strike detection, wherein at least a moment of impact of a strike is determined in time and the sensor signal from the microphone is used to record a sound fragment for further tone analysis according to the method of the invention. When a strike is then detected in a sensor signal coming from the piezo-transducer in the step of trigger method 24, a sound fragment can be recorded in order to form the sensor signal from the microphone in step 25 so that the sound fragment originating from the sensor signal of the microphone can be considered according to the steps of the method of the invention. When employed in a set with multiple drums, such a vibration sensor 23, when the piezo-transducer is directly or indirectly connected mechanically to the considered drum, provides a signal in which strikes which have taken place on the considered drum can be detected in an effective manner, because in the sensor signal thereof the mechanical vibration related to a strike on the drum can be efficiently detected and this mechanical vibration can be distinguished from a sound originating from a strike on another drum to which the piezo-transducer is not directly or indirectly mechanically connected. It is hereby possible with increased certainty to avoid ambient sound or a strike on a drum other than the considered drum unintentionally resulting in recording of a sound fragment in step 25, where it would be more difficult on the basis of only the sensor signal from a microphone to distinguish whether the detected strike is a strike on the considered drum or a strike on another drum, or is even only ambient sound which has unintentionally been detected as a strike. The considered drum is understood here to mean the drum it is wished to tune. The terms vibration sensors 23, vibration sensor 23 and sound recording device 23 further comprise a further unspecified quantity of sensors of the same sensor type or a combination of differing sensor types. Reference is consequently made on occasion in this text to vibration sensors 23, vibration sensor 23 and sound recording device 23 using the term 'microphone'. The signal from these vibration sensors 23** is referred to on occasion with the term 'microphone signal', or sometimes also 'sound'.

A fragment of the signal from vibration sensors 23, the 'microphone signal', is sometimes referred to in this text as 'sound fragment'. It will be apparent to a skilled person that there is a wide variety of vibration sensors 23 which can generate and/or influence a signal in relation to a movement in or a vibration of a skin 4, and which are consequently suitable for recording a sound fragment. The thus influenced or generated sensor signal is further not necessarily limited to the sound actually generated or discernible to us which results from vibration of skin 4, nor is it limited to a wholly faithful reproduction thereof. A microphone is known to be able to record a sound fragment correctly over a notably large frequency range.

Via the user interface of the user a center strike is preferably requested, or alternatively the user indicates that he/she wishes to perform a center strike, and it is therefore assumed that the strike detected in step 24 is a center strike. Following recording of a first sound fragment in step 25, the whole sound fragment is preferably analyzed in step 27 for the purpose of determining the fundamental tone amplitude 15 of the fundamental tone frequency 14.

Depending on the trigger setting in step 24 and recording setting in step 25, the sound fragment may comprise the whole resonance or reverberation duration of a strike. Only a part of the sound fragment can also be analyzed for this purpose, in which case preferably a first part thereof in time, in order to determine herein the location and the amplitude of the fundamental tone frequency range or of the fundamental tone, and wherein in the shortest possible time period following the strike an accurate determination thereof is performed in step 27. It is also possible in a second time segment of the sound fragment, for instance when the amplitude of the signal has fallen below a determined level of the measured maximum amplitude, to determine the position of fundamental tone 14 and a specific overtone thereof. This is based on the insight that over the whole resonance or reverberation duration of a strike the overtones have a more pronounced presence relative to fundamental tone 14 in the frequency spectrum of a strike at the end of a strike than at the beginning thereof.

The location of the first overtone relative to fundamental tone 14 is typically inharmonic, and so typically other than in the case of instruments having a harmonic overtone interval structure, such as for instance stringed instruments. The higher the overtones in the frequency spectrum, the smaller the ratio becomes between the vibration numbers of the overtones, or the intervals between the overtones. In contrast to harmonic instruments, the ratio between the vibration numbers is not an integer in the case of a drum. The ratio between the vibration numbers, also referred to as the intervals between the fundamental tone and overtones, of drums with multiple skins moreover depends on the tension of the individual skins. Since a drum with multiple skins is an acoustically coupled system, the above ratio is moreover not constant but depends on the individual skin tensions and the volumetric properties of the air volume associated with the skins. The vibrating air column, the internal air volume of the drum which is enclosed between the skins of a drum with multiple skins and which is thus acoustically coupled thereto, reduces the intervals between the overtones, thereby decreasing their pitch. The intervals between the overtones and fundamental tone 14 of a drum 1 with two skins 4 typically depend on the tuning of the individual skins 4. The tuning of the individual skins 4 determines the location of their first overtone frequency range relative to fundamental tone 14 of drum 1. On the basis of a fundamental tone frequency 14 measured in step 27 of a sound fragment of a first strike on a skin 4 of drum 1 recorded in step 25, a predetermined algorithm allows determination of separate first overtone frequency ranges for the individual skins 4 of drum 1 within which the first overtone of the individual skins 4 is most probably situated. A filter can hereby be adjusted in step 28, whereby during consideration of each further edge strike on a skin 4 of drum 1 the first overtone can be determined with great certainty in step 32. During the calculation the predetermined algorithm takes into account a non-constant ratio between the vibration numbers of the overtones.

When in step 25 a sound fragment has been recorded, this sound fragment is converted in step 26 from the time domain to the frequency domain. In the case of a center strike the method will continue after step 26 with step 27, the situation of a center strike being indicated here in the figure by arrow 29. The fundamental tone is detected in step 27. For the detection of the fundamental tone a part of the recorded sound fragment is considered which optionally comprises the whole sound fragment. In particular the fundamental tone frequency 14 and optionally also the fundamental tone amplitude 15 will be determined. In step 28 a filter can then be determined on the basis of the fundamental tone frequency, and preferably the fundamental tone amplitude. The filter determined in step 28 comprises at least a pass frequency band, and preferably also a pass amplitude range. When the filter has been determined in step 28, the method will start again from the beginning, with the difference that, after the filter has been determined in step 28, edge strikes are requested from the user. These are strikes on zones 7 in FIG. 1.

An analysis of a second part of a first sound fragment, in which case preferably a later part thereof in time, which optionally wholly or partially comprises the above stated first part thereof, is preferably suitable for a further determination of an area in which the various first overtones of the fundamental tone, which are generated close to the different individual tuning control locations (e.g. the tensioning pegs), can be expected. Information can in this way be obtained during analysis of a first sound fragment of a strike about the fundamental tone as well as information about the anticipated location of the first overtones per tuning control location. This analysis provides the advantage that an algorithm can be employed which, without prior knowledge of the interval between the fundamental tone and the first overtones per tuning control location, determines more robustly and with greater accuracy an area comprising the probable location of the individual overtones generated close to the separate tuning control locations. This makes possible the use of an adaptive analysis algorithm for the first overtone which takes into account the variables such as are present in each individual first sound fragment. The determining of the area of the first overtone can thus be adjusted adaptively in each case to the conditions present per first sound fragment, for instance for the different strikes on different drums and/or on differently tuned drums.

Once steps 24 to 26 have been completed for the edge strike, the method will continue with step 31. This is illustrated by arrow 30 which indicates that the strike is an edge strike. An edge strike is preferably requested via the user interface of the user and it is consequently assumed that the detected strike is an edge strike. The user alternatively indicates via the user interface that he/she wishes to perform an edge strike.

In step 31 the filter is placed such that in step 32 the first overtone can be detected from the sound fragment of the edge strike. In step 33 the detected overtone frequency from step 32 is then compared to the calculated overtone frequency of step 28. On the basis of the comparison 33 the user interface indicates to the user in step 34 whether skin 4 must be tensioned, slackened or is optimal at the location of the edge strike. By analyzing multiple edge strikes along the periphery of the skin in this way a user can tune skin 4 in a simple manner.

The calculated overtone frequency can in this example also be a predetermined target overtone frequency which may or may not be an ideal overtone frequency. When an indication of the tuning is given in step 34, it is likewise possible for a fundamental tone frequency or an overtone frequency or first overtone frequency to be shown here, and wherein a difference as obtained from step 33 is optionally explicitly shown. It is even possible in an alternative embodiment to skip step 33 and that step 34 involves the direct display of a target tone, a fundamental tone frequency or an overtone frequency as for instance determined in step 32.

FIG. 6 shows a schematic representation of an apparatus suitable for performing the method of FIG. 5. The apparatus comprises a housing 35 with a microphone 37. In FIG. 5 microphone 37 is shown inside housing 35, although the microphone can also be formed externally and coupled operationally to housing 35. The apparatus further comprises a user interface 36 which is shown in FIG. 6 as a display. As already stated above however, LEDs or a loudspeaker can also be provided as a user interface 36 as alternative to a display. User interface 36 in FIG. 6 comprises both an information output part and an information input part with which for instance settings of the method can be adjusted or functions can be activated or deactivated, and other methods such as, among others, buttons, controls or controllers are likewise suitable as alternative to a display. A user could thus manipulate the adjustment of variables in the individual steps of FIG. 5 or, according to the method, communicate to the apparatus whether a center strike 29 or an edge strike 30 will be performed. The apparatus further comprises a memory 38 and a processor 39. Processor 39 is provided here in combination with memory 38 for performing the steps which are shown in FIG. 5 and which have been explained above with reference to FIG. 5.

The apparatus can comprise further elements 40. Shown in FIG. 6 is the example of a clamp with which the apparatus can be clamped onto an object. The apparatus can alternatively be provided with a tuning key as further element 40 with which the user can manipulate the tuning pegs of lugs 8. It will be apparent to the skilled person that more embodiments can be envisaged for integration of the apparatus according to the invention.

As further alternative the method as shown in FIG. 5 can be integrated into a software application for a data processing device such as a smart device, such as a smart phone or a laptop. Such integration would allow tuning of a drum via a smart phone.

The apparatus according to the invention can further be applied in a situation in which a fundamental tone is determined beforehand, for instance selected manually by a user or calculated in relation to other fundamental tones within a set, and consequently not measured from a first sound recording. On the basis of this predetermined fundamental tone the filter can then be set so that overtones are more easily detectable, as discussed at length above.

Figure 7:
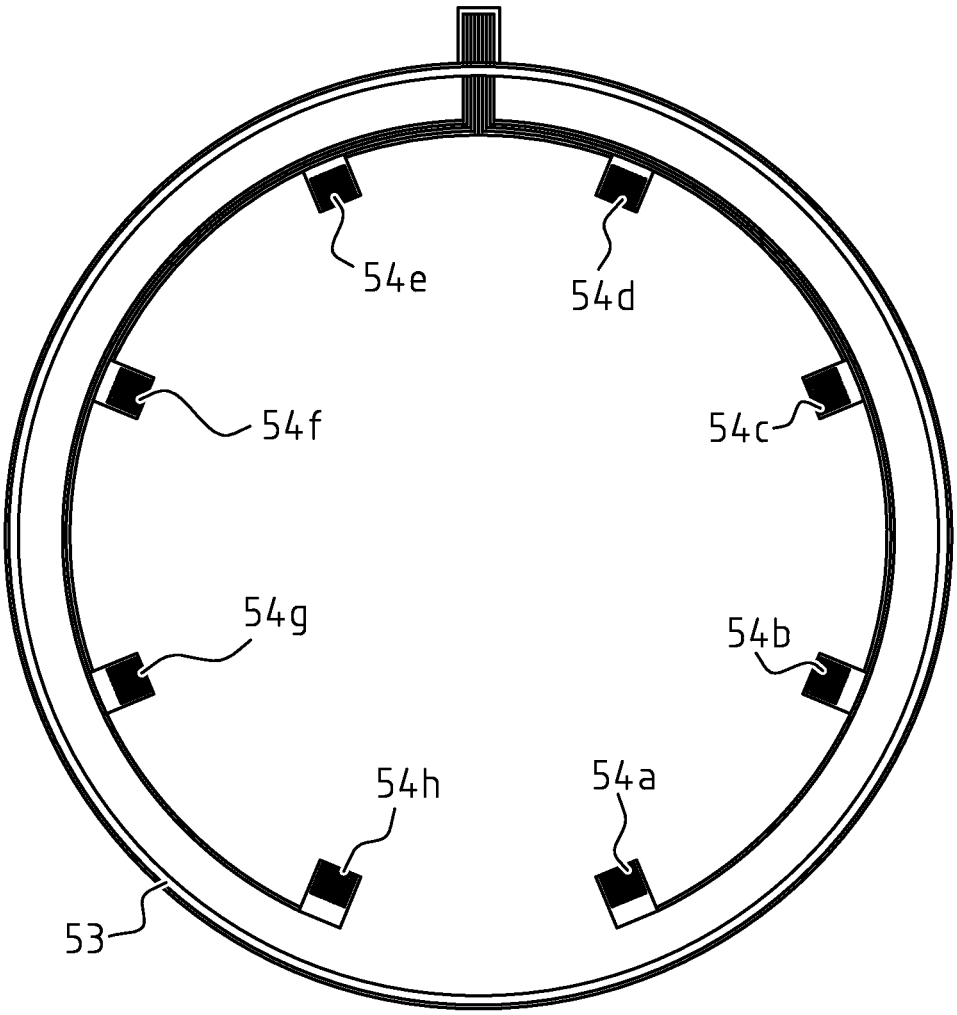
FIG. 7 shows a drum with a skin comprising a sensor suitable for application in the present invention.

FIG. 7 shows an example of an embodiment of a vibration sensor 23 or microphone. Vibration sensor 23 consists here of a plurality of sensors arranged on a skin 4, wherein the individual sensors are designated with reference numerals 54*a*-54*h*. These sensors 54*a*-54*h* are arranged in this example by techniques such as, among others, printing and coating. In FIG. 6, when the skin is tensioned over the rim of a drum, the individual sensors 54*a*-54*h* of vibration sensor 23 are situated close to the separate tuning control locations of skin 4, whereby vibration sensor 23 has a number of separate sensor signals corresponding to the number of sensors of which vibration sensor 23 consists.

When the individual sensor signals from the plurality of sensors 54*a*-54*h* are processed simultaneously, though separately, for the purpose of performing trigger method 24 and recording step 25, the separate signal content of the plurality of sensors 54*a*-54*h* are considered simultaneously for performing the further steps according to the method of this invention.

On the basis of only a single strike on skin 4 information is hereby obtained per sensor 54*a*-54*h* about: the fundamental tone of the drum as performed in step 27, the overtones close to the separate tuning control locations as performed in step 32, as well as about the hardness of the strike and the impact location thereof as performed in step 24 and 25.

Determining the filter in step 28 and setting the filter in step 31 take place in this example either individually per sensor 54*a*-54*h* on the basis of separate filters with separate settings, or this alternatively takes place collectively for the plurality of sensors 54*a*-54*h* on the basis of separate filters with a collective adjustment. According to the method of the invention this allows, per sensor 54*a*-54*h* and so per tuning location, the first overtone to be determined in step 32 in a pass frequency range of an individual sound fragment per sensor 54*a*-54*h* from the same strike on skin 4.

The information obtained per sensor 54*a*-54*h* can then be combined or grouped so that for instance an overall picture of the fundamental tone frequency of skin 4 is obtained or so that for instance a correlated picture of the first overtones from the tuning control locations of tuning control means related to each other, such as tuning control means lying adjacency of or over each other, can be considered for further processing thereof. The sensor signals from multiple skins with sensors 54*a*-54*h* of the same drum can also be considered simultaneously in similar manner during the same strike on the drum.

Figure 8:
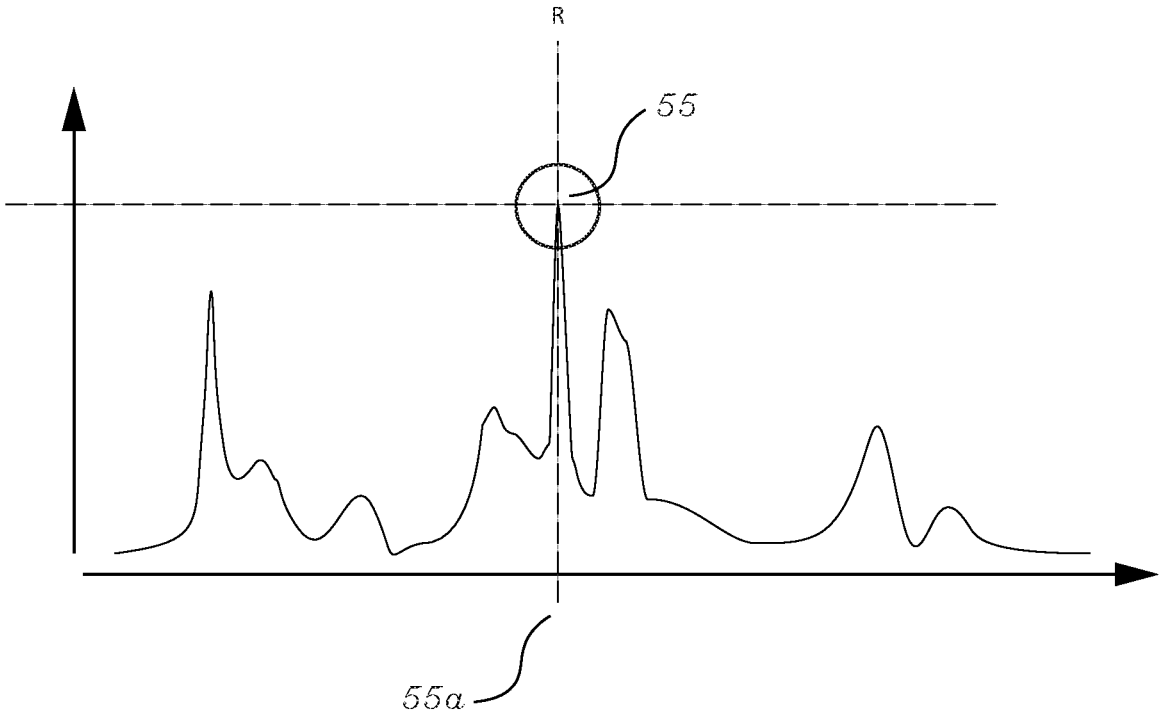
FIG. 8 shows a signal content of a first strike buffer.

FIG. 8 shows a first step of a further embodiment in which a first strike buffer, which for instance comprises signal content of an edge strike or a center strike, is considered. Via a detection algorithm suitable for the purpose a search is made within the power spectrum of this first strike buffer or in a part of this strike buffer for a suitable magnitude peak 55 which could be a maximum magnitude peak. The detected peak 55 is selected and a frequency related thereto is determined. This detected peak or this frequency related thereto is deemed as detected tone 55*a*.

In order to determine the frequency related to the selected peak it is for instance possible in a preferred embodiment that a rounding-off takes place, or that for instance a spectral centroid around the selected peak is calculated, and that the found spectral centroid is optionally further rounded off to preferably a multiple of 0.1 Hz, prior to an optional display thereof via the user interface as detected tone 55*a* or as an indication thereof which is related thereto.

Via the user interface a value or indication is thus shown which is related to selected peak 55 or to detected tone 55*a*, and the user then activates the focus mode via the user interface, whereby the location of selected peak 55, detected tone 55*a* or a position related thereto is stored as reference R for the purpose of setting a focus area during each subsequent strike. Detected tone 55*a* or selected peak 55 or the reference R is also stored here as target tone.

Figure 9:
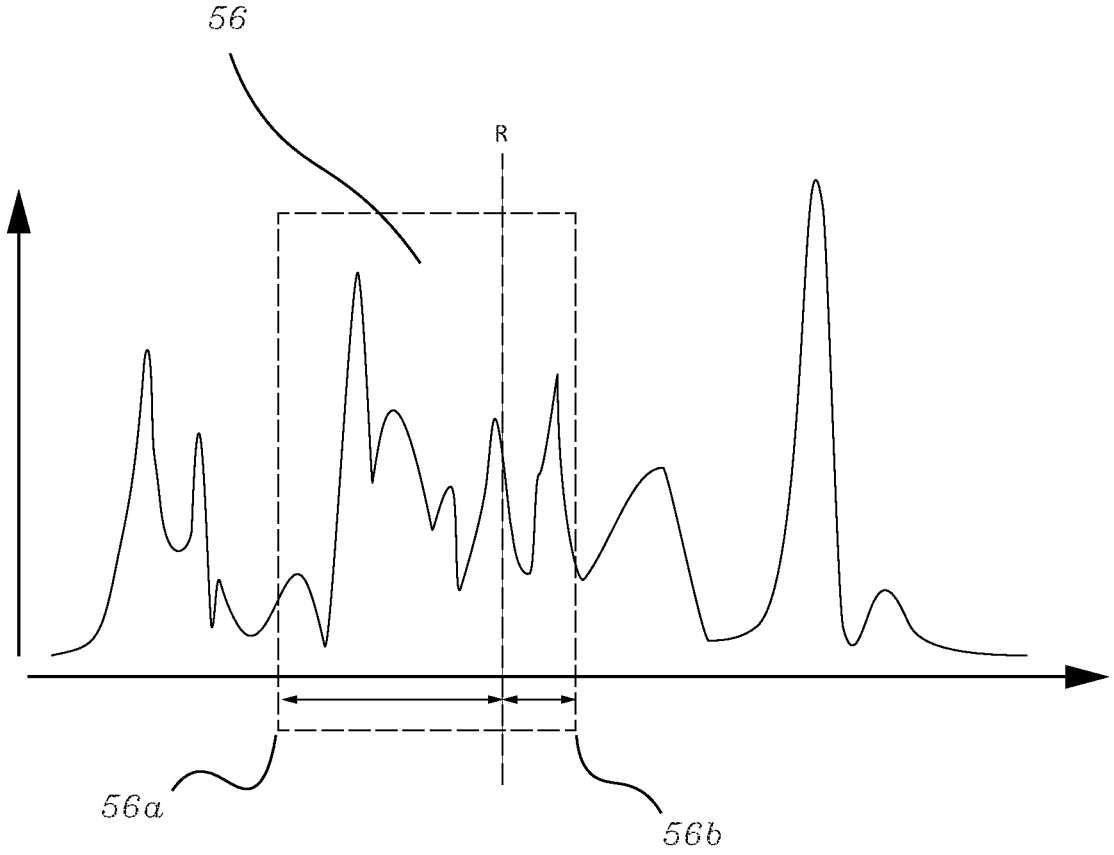
FIG. 9 shows a signal content of a subsequent strike.

FIG. 9 shows a second step of the further embodiment wherein during each subsequent strike, which could for instance be an edge strike or a center strike, when the focus mode is active a focus area 56 is determined in the power spectrum of this subsequent strike, the band width of which running from 56*a* to 56*b* is related to the reference R stored from a first strike. In this case the focus area is determined asymmetrically relative to reference R, though it is equally possible to determine this focus area 56 symmetrically, wherein the distance between R and 56*a* is equal to the distance between R and 56*b*.

Figure 10:
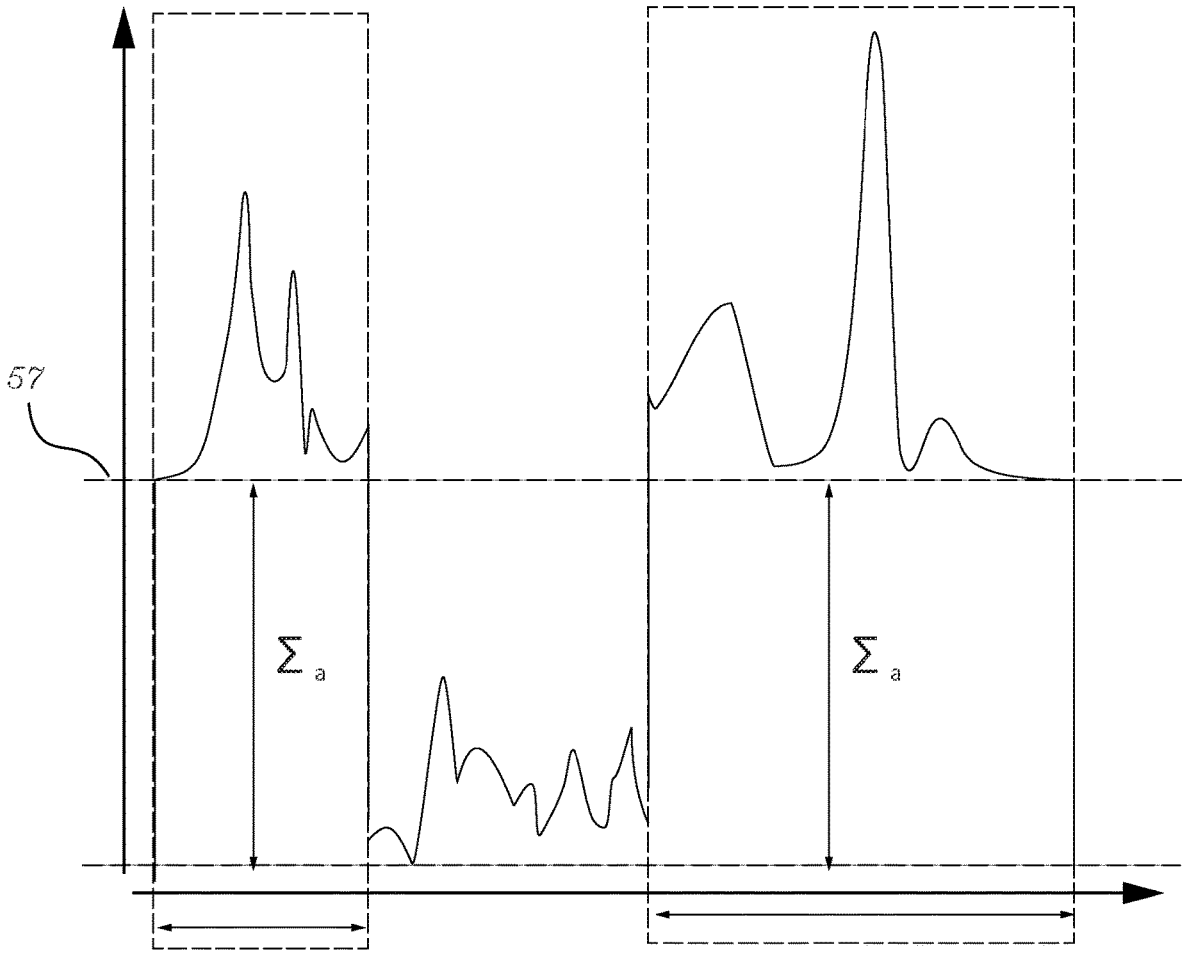
FIG. 10 shows a power spectrum of the same subsequent strike.

FIG. 10 shows a third step of the further embodiment wherein in the power spectrum of the same subsequent strike a magnitude manipulation is subsequently performed in the power spectrum thereof or in a part thereof. In the preferred embodiment in this example all magnitudes outside the focus area are preferably multiplied by a determined value E a, which E a is for instance the sum 57 of all magnitudes of all individual frequency bins of the power spectrum over the total discerned frequency range in the strike buffer. Different values could alternatively be used, or all magnitudes outside the focus area could be multiplied by a determined coefficient, etc. . . . .

Figure 11:
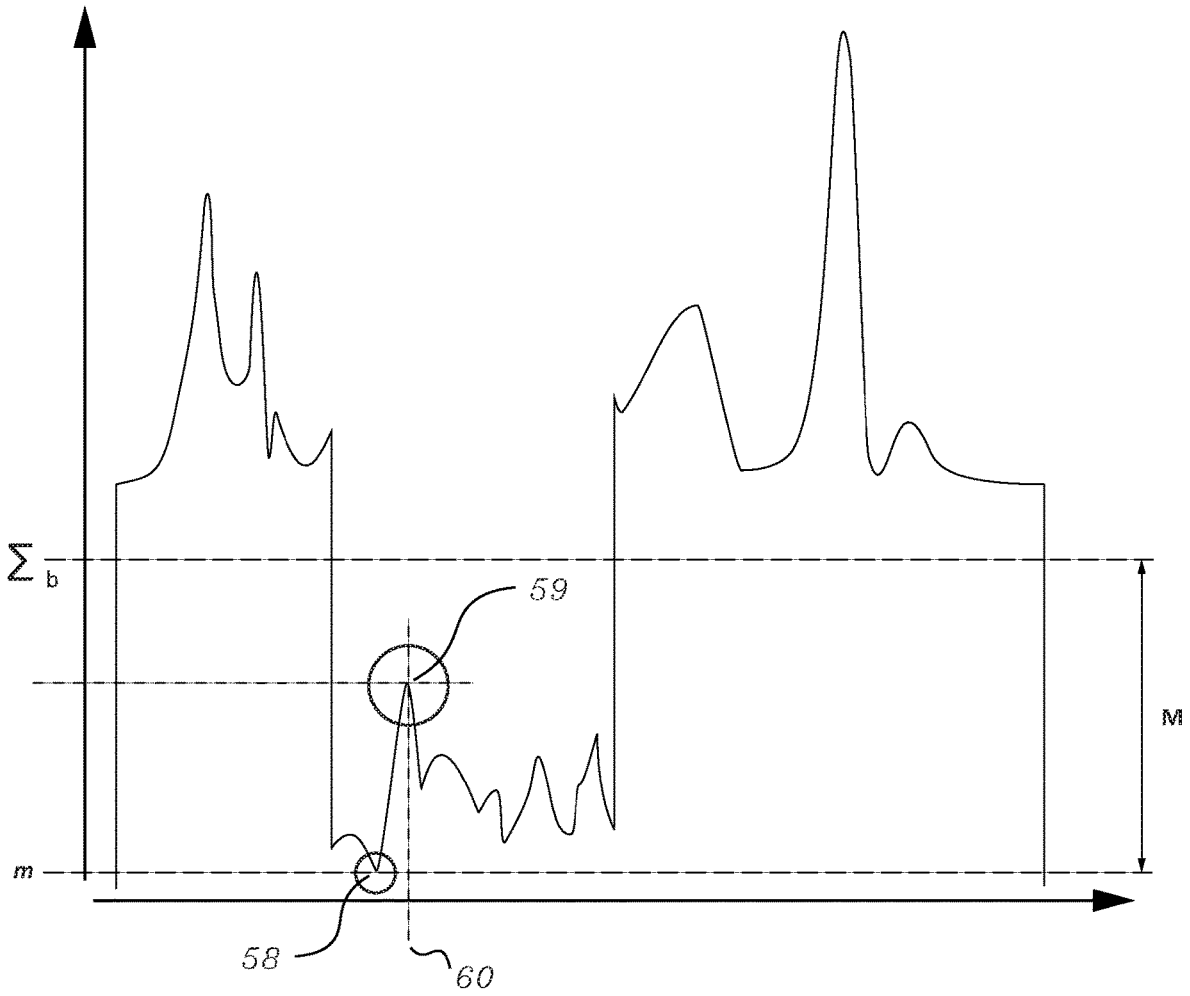
FIG. 11 shows a power spectrum of the same subsequent strike.

FIG. 11 shows a fourth step of the further embodiment wherein a magnitude range M is subsequently determined in the power spectrum of the same subsequent strike, this for instance taking place by setting both a minimum and a maximum magnitude threshold value Σ b, which Σ b is for instance the sum of all magnitudes of all individual frequency bins of the power spectrum within the focus area, and which minimum magnitude threshold value m for instance corresponds to the minimum magnitude measured in a frequency bin of the power spectrum within the focus area, this corresponding to minimum magnitude peak 58. It is likewise possible to use another value for m, or not to use a threshold value m to determine the range M.

Over the whole discerned spectrum of the same subsequent strike, so over all bins of the power spectrum of the strike buffer, or of a part of this strike buffer, a search is then made for a suitable magnitude peak 59 within the determined magnitude range M, which can be a maximum magnitude peak within this determined magnitude range M. This suitable magnitude peak 59 is then detected via an algorithm suitable for this purpose. The detected peak is selected and a frequency related thereto is determined. This detected peak or this frequency related thereto is deemed as detected tone 60.

In order to determine the frequency related to the selected peak it is for instance possible in a preferred embodiment that a rounding-off takes place or that for instance a spectral centroid around the selected peak is calculated, and that the found spectral centroid is optionally further rounded off to preferably a multiple of 0.1 Hz, prior to an optional display thereof via the user interface as detected tone 60 or as an indication thereof which is related thereto.

In yet another preferred embodiment an indication related to a difference between detected tone 60 and a target tone is given here via the user interface, which target tone is for instance the reference R or detected tone 55*a* from step 1.

It is noted that, following detection of a peak at a further strike, a refining step can be performed each time in order to measure the characteristics of the peak with greater accuracy. A focus mode as described with reference to FIGS. 8-11 can for instance be employed as refining step.

Figure 12:
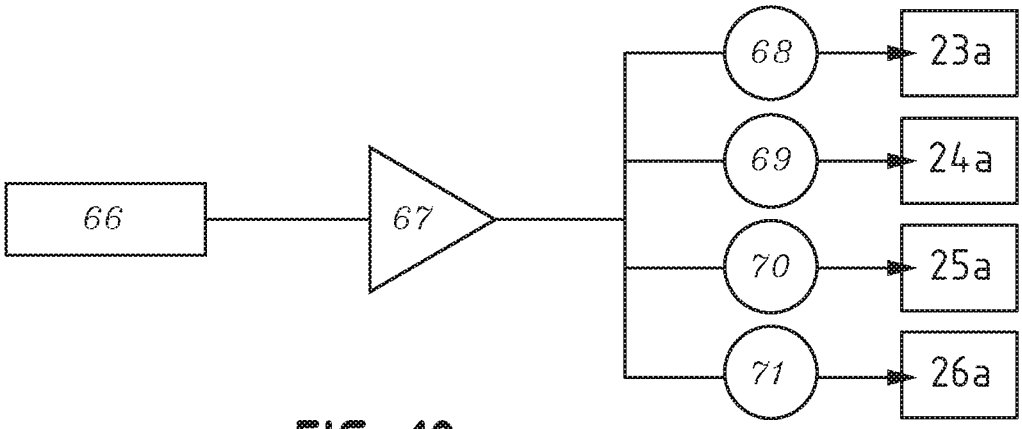
FIG. 12 illustrates a diagram of the different steps of the method according to the invention wherein, based upon the specific input of instrument data, a determining step determines as output: which following steps are executed, and what type of settings are applied in these steps when they are executed.

FIG. 12 shows in a block diagram the different steps of the method according to the invention wherein, based upon the specific input of instrument data 66, a determining step 67 determines as output: which of the following steps 23*a*, 24*a*, 25*a*, 26*a* are executed, and what type of settings 68, 69, 70, 71 are applied in the steps 23*a*, 24*a*, 25*a*, 26*a* when they are executed.

Hereby the type of settings 68, 69, 70, 71 that are applied in steps 23*a*, 24*a*, 25*a*, 26*a* are determined in a determining step 67, which has at least one of the following determining data 66 as input, also referred to as instrument data 66:

a frequency response curve, for example related to the frequency response of a vibration sensor or microphone, but not limited thereto;

an ambient sound content data, which could be measured, analyzed, recorded, predicted through calculation, or obtained in any other way or by any other manner;

an audio acquisition mode provided by an operating system: for example like OS, Windows, Android, iOS or alike or any successor thereof, but not limited thereto;

a noise canceling mode;

a gain control mode;

an audio acquisition mode with or without integrated signal processing steps;

a voice recognition mode;

a drumhead type;

a type of instrument, for example like: a tom, a floor tom, a snare drum, a kick drum, a conga, a bongo, a tympani, a marching drum, a tambourine, a hand drum, a djembe, a guitar, a string instrument, a saxophone, a wind instrument, a piano, but not limited thereto;

a diameter of a drum;

a depth of a drum;

a volume of a drum;

a brand of a drum;

a series of a drum;

an impact location on a drumhead;

a type of stroke, strike or hit;

a thickness of a drumhead;

a mass of a drumhead;

a type of a drumhead;

a batter head;

a resonant head;

a type of tone like: a fundamental tone, an overtone of a certain order, like the first overtone for example;

a frequency or note related to at least of the following: a fundamental tone, an overtone of a certain order, like the first overtone for example;

a frequency;

a frequency range;

a note;

a note range;

a tone;

a tone range;

This determination performed by determining step 67 is based upon the input of instrument data 66 and at least one of the following:

a calculation;

a logic analysis;

an execution of a logic instruction set;

instructions or information retrieved from a database;

instructions or information retrieved from a look-up table;

instructions or information received from an external source;

instructions or information received via an input like an interface;

or instructions information obtained by any other matter.

In the scope of this invention it is important that the determination performed by determining step 67 and its output is based upon the specific input of instrument data 66.

However, hereby it is not of any further importance how the input instrument data 66 is provided to determining step 67, neither is it of any further importance how the determining step 67 determines which of the following optional steps 23*a*, 24*a*, 25*a*, 26*a* are executed, and how the determining step 67 determines what type of settings 68, 69, 70, 71 are applied in the steps 23*a*, 24*a*, 25*a*, 26*a*.

For example in a case when it is required to detect strike on a drum in a setting with much ambient sound that may mask the sound of the drum, or in a case when it is required to detected a tone in a situation wherein the drum generates a lot of overtones that interfere with the correct detection of a desirable tone, like a fundamental tone or a first overtone thereof, the efficiency of the observation of a strike on a drum by a user could be low, and/or the correct detection of a desirable tone could be erratic without the execution of at least one of the following steps 23*a*, 24*a*, 25*a*, 26*a*.

Figure 13:
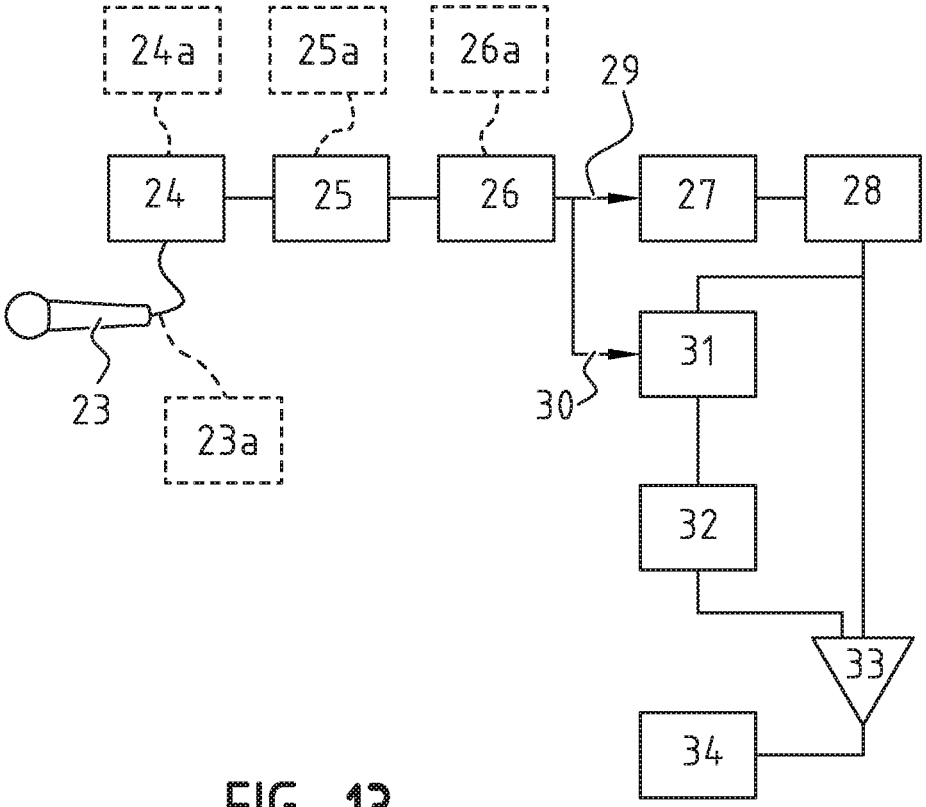
FIG. 13 illustrates a diagram of the method of the invention according to an embodiment of the invention, wherein based upon the specific input of instrument data, additional steps are executed.

However when the method of FIG. 13 is applied, wherein steps 23*a*, 24*a*, 25*a*, 26*a* are related to the input of instrument data 66, the strike detection efficiency and tone detection robustness is much increased.

For example if 'a drum type' is used as instrument data 66, then this drum type is the input of the determining step 67, in which case said step can determine at least one type of settings 68, 69, 70, 71 in such a way that any signal content in the sound fragment belonging a frequency range which is not related to the a typical tuning frequency range of a conga, thus a range that contains the fundamental tone and the first overtone thereof, is removed from the vibration sensor signal and/or sound fragment and/or that preferably any content belonging to the typical tuning frequency range of a conga is amplified.

By removing unwanted signal content from said vibration sensor signal and/or by amplifying desirable signal content in said vibration sensor signal in step 23*a*, the vibration sensor signal is optimized for a successful detection of a strike on the drum of a given drum type in a noisy environment in step 24.

Also the successful detection of the fundamental tone in step 27, and the successful detection of the overtone tone in step 32 is improved for the given drum type in the given sound environment when with the abovementioned type of settings 68, 69,70, 71 applied.

Hereby the user is able to tune the drum in a more efficient manner, with less missed strikes, and less erratic tone detections, coming from interference of unwanted signal content like overtones or ambient noise.

In another example the power spectrum is equalized or modified in at least one of the following steps 23*a*,24*a*, 25*a*, 26*a*, for example to achieve a flat frequency response in the sensor signal, the sound fragment, its power spectrum or a part thereof, in such a way that it compensates for flaws in the frequency sensitivity of vibration sensor 23, which increases the chance of a correct detection of a strike in step 24, or which increases the chance of a correct detection of a tone in step 27, or 32. Without this correction step of the frequency response curve, the tone detection would be biased by the uneven sensitivity of the vibration sensor throughout the spectrum.

FIG. 13 shows the method for assisting a user in tuning a drum, as described in FIG. 5, wherein the method further comprises at least one of the following additional steps: 23*a*, 24*a*, 25*a* and 26*a*.

Each of the steps 23*a*, 24*a*, 25*a* and 26*a* contain a type of settings 68, 69,70, 71 which are determined in determining step 67 based upon instrument data 66, as shown in FIG. 12. Therefore said type of settings 68, 69,70, 71 are specifically related to the specific instrument data 66 that is used as input for determining step 67.

The following type of settings define the type of action performed during the execution of their related step:

types of conditioning 68 for a signal optimization step 23*a;* strike detection parameters and settings 69 for a triggering optimization step 24*a;* recording settings 70 for a sound fragment optimization step 25*a;* domain conversion parameters and settings 71 for a frequency domain optimization step 26*a.*

An illustration of the type of settings and their type of action is illustrated in the text below.

Signal optimization step 23*a* has the purpose to optimize the signal acquired from vibration sensor 23 for successful execution of at least one of the succeeding steps, whereby the input signal coming from vibration sensor 23 is conditioned or in the time domain or in the frequency domain, or in the complex domain, or in a combination thereof, by applying at least one of the following techniques, conditioning settings 68 or types of conditioning 68:

A signal smoothing;

A signal filtering in order to change the frequency content of the signal of one or more frequency bands;

A smoothing of bins of a power spectrum;

A modification of the magnitude of at least one bin of the power spectrum, or of at least one frequency band;

A modification of at least a part of the signal content of the sensor signal in at least one of the following domains: a time domain, a frequency domain, a complex domain, whereby said sensor signal can be in analog or in digital form, and whereby the aforementioned modification of the signal content is one of the following modification types: an amplification, a shelving, an attenuation, a leveling, a normalizing, an equalizing, and whereby this modification type is affecting or whereby these modification types are affecting the full spectrum of the sensor signal or a part thereof, or whereby this modification type is affecting or whereby these modification types are affecting one or more frequency bands of the sensor signal or a part thereof, whereby at least one of the bands contains at least one frequency;

An ambient sound content and level;

A low pass filter;

A high pass filter;

A band pass filter;

A notch filter;

A shelving type of filter;

An attenuation;

An amplification;

An equalizing;

A normalization;

A level of intensity, an amplitude, a magnitude, a ratio, a value or any other relative or absolute value to set the amount of modification mentioned above;

A sample rate for ADC;

A buffer over-sampling amount, which could be a formula, a ratio or any other relative or absolute value suitable to set the amount of over-sampling;

A buffer down-sampling amount, which could be a formula, a ratio or any other relative or absolute value suitable to set the amount of down-sampling;

A buffer size;

A zero padding amount, which could be formula, a ratio or any other relative or absolute value suitable to set the amount of zero-padding.

The above list is an illustration of a selection of possible types of conditioning 68 only and it is not restrictive. In the scope of this invention, also other types of conditioning 68 of the signal content of the sensor signal are included in step 23*a*.

Triggering optimization step 24*a* has the purpose to ease the detection of strike on a drum in trigger method 24.

Hereby, as further described below, strike detection parameters and settings 69 are set in step 24*a* in order to optimize the successful detection of a strike on a drum. Detecting a strike on a drum or detecting a hit on a drum is sometimes also referred to as 'triggering'.

By the execution of steps 23 and 24 together, a strike by a user on a drum is considered.

To consider a strike on a drum, a sensor signal is acquired from a vibration sensor in step 23 whereby the signal can be optionally conditioned in step 23. Thereafter, in step 24, the sensor signal is analyzed in at least one of the following domains: the time domain or in the frequency domain, or in the complex domain, or in a combination thereof, to detect at least: an onset event which is related to a strike on a drum.

The detection of a strike on a drum in step 24, can be optimized by applying at least one of the following techniques or strike detection parameters and settings 69 in a step 24*a:*

A strike detection threshold exceeding duration;

A strike detection magnitude threshold in at least one strike detection frequency range;

A rate of change threshold;

A phase threshold;

An oversampling rate;

A downsampling rate;

A sample buffer size;

A duration in time;

A magnitude manipulation amount;

A magnitude manipulation frequency band;

A spectral centroid range;

At least one strike detection frequency range wherein strike detection analysis is performed. Such a strike detection frequency range can either completely contain the full spectrum, or it could contain at least one frequency band thereof. Said frequency band thereof could be defined by determining at least one cut-off frequency under which, above which, or around which the strike detection frequency range is located. Hereby the cut-off frequency could be comprised within or be excluded from said frequency band thereof;

An amplitude modification amount. Whereby the amount is for example being a relative value or an absolute value, but not limited thereto, and whereby the modification is for example being an amplification, a shelving, an attenuation, but not limited thereto;

A magnitude modification amount. Whereby the amount is for example being a relative value or an absolute value, but not limited thereto, and whereby the modification is for example being an amplification, a shelving, an attenuation, but not limited thereto.

The above list is an illustration of a selection of possible types of strike detection parameters and settings 69 only and it is not restrictive. In the scope of this invention, also setting other types of strike detection parameters and settings 69 are included in step 24*a*.

Sound fragment optimization step 25*a* has the purpose to optimize the recorded sound fragment of step 25 for the successful execution of at least one of the succeeding steps: 26, 27, 28, 29, 30, 31, 32, 33.

Hereby a signal buffer or a sound fragment is recorded in step 25 and at least one of the following recording settings 70 is applied in applied in step 25*a:*

A pre-attack comprise time, or any other setting to include signal content of the moment preceding an impact of a strike in a buffer, or in a recorded sound fragment;

An attack comprise time, or any other setting to include signal content of the initial moment of impact of a strike in a buffer, or in a recorded sound fragment;

An attack skip time, or any other setting to exclude signal content the initial moment of impact of strike from a buffer, or in a recorded sound fragment;

A hit threshold exceeding duration;

One or more hit detection frequency ranges;

A hit detection magnitude threshold in at least one hit detection frequency bands;

A rate of change threshold;

A phase threshold;

A buffer over-sampling amount, which could be a formula, a ratio or any other relative or absolute value suitable to set the amount of over-sampling;

A buffer down-sampling amount, which could be a formula, a ratio or any other relative or absolute value suitable to set the amount of down-sampling;

A buffer size;

A zero padding amount, which could be formula, a ratio or any other relative or absolute value suitable to set the amount of zero-padding;

A buffer size of the recorded sound fragment;

A magnitude manipulation amount;

A magnitude manipulation frequency band;

The above list is an illustration of a selection of possible types of recording settings 70 only and it is not restrictive. In the scope of this invention, also setting other types of recording settings 70 are included in step 25*a*.

Frequency domain optimization step 26*a* has the purpose to ease the successful detection a suitable tone of a strike on a drum, for example in step 27 or in step 32.

Hereby, either all of the steps 29, 30, 28, 31, 33, 34 could be executed, or either it could be possible to skip the execution of at least one of the steps 29, 30, 28, 31, 33, 34, in which case for example the detected tone could be memorized for further processing and/or a value related thereto could be outputted to the user directly, with or without the execution of steps 33 and 34.

The aforementioned detected tone, for example as result of step 27 or 32, can be the fundamental tone, or an overtone like the first overtone of the fundamental tone, or any higher order overtone thereof.

In step 26*a* is at least one of the following domain conversion parameters and settings 71 are applied:

A conversion algorithm to convert the recorded sound fragment of step 25 from the time domain to the frequency domain;

A log size of an FFT or of a related transform;

A windowing type;

A hopping size;

A modification of at least a part of the frequency content of the in step 24 recorded sound fragment or a of part thereof in at least one of the following domains: a frequency domain, a complex domain, whereby the aforementioned modification of the frequency content is one of the following modification types: an amplification, a shelving, an attenuation, a leveling, a normalizing, an equalizing, and whereby this modification type is affecting or whereby these modification types are affecting the full spectrum of the recorded sound fragment or a part thereof, or whereby this modification type is affecting, or whereby these modification types are affecting one or more frequency bands of the recorded sound fragment or of a part thereof, whereby at least one of the bands contains at least a sort of frequency content;

an ambient sound content and level;

A frequency range inside of which, outside of which, or around which frequency content will be modified by a modification of the magnitudes of the spectral content in a power spectrum;

A frequency above which, below which, or around which, frequency content will be modified modification of the magnitudes of the spectral content in a power spectrum;

A low pass filter in a power spectrum or in a related representation of the signal content of the recorded sound fragment or of a part thereof;

A high pass filter in a power spectrum or in a related representation of the signal content of the recorded sound fragment or of a part thereof;

A band pass filter in a power spectrum or in a related representation of the signal content of the recorded sound fragment or of a part thereof;

A notch filter in a power spectrum or in a related representation of the signal content of the recorded sound fragment or of a part thereof;

A shelving type of filter in a power spectrum or in a related representation of the signal content of the recorded sound fragment or of a part thereof;

An attenuation in a power spectrum or in a related representation of the signal content of the recorded sound fragment or of a part thereof;

An amplification in a power spectrum or in a related representation of the signal content of the recorded sound fragment or of a part thereof;

An equalizing in a power spectrum or in a related representation of the signal content of the recorded sound fragment or of a part thereof;

A normalization in a power spectrum or in a related representation of the signal content of the recorded sound fragment or of a part thereof;

A level of intensity, an amplitude, a magnitude, a power, an energy amount, a ratio, a value or any other relative or absolute value to set the amount of modification mentioned above of the recorded sound fragment or of a part thereof;

A buffer over-sampling amount, which could be a formula, a ratio or any other relative or absolute value suitable to set the amount of over-sampling of the recorded sound fragment or of a part thereof;

A buffer down-sampling amount, which could be a formula, a ratio or any other relative or absolute value suitable to set the amount of down-sampling of the recorded sound fragment or of a part thereof;

a buffer size;

A zero padding amount, which could be formula, a ratio or any other relative or absolute value suitable to set the amount of zero-padding;

A peak to peak cutting setting;

A signal smoothing algorithm;

A frequency response curve, for example related to the frequency response of a vibration sensor or microphone, but not limited thereto, An audio acquisition mode provided by an a logic program, a software application or an operating system: for example like OS, Windows, Android or iOS, but not limited thereto, A noise cancellation;

An echo cancellation;

A gain control;

The above list is an illustration of a selection of possible types of domain conversion parameters and settings 71 only and it is not restrictive. In the scope of this invention, also setting other types of domain conversion parameters and settings 71 are included in step 26*a*.

Figure 14:
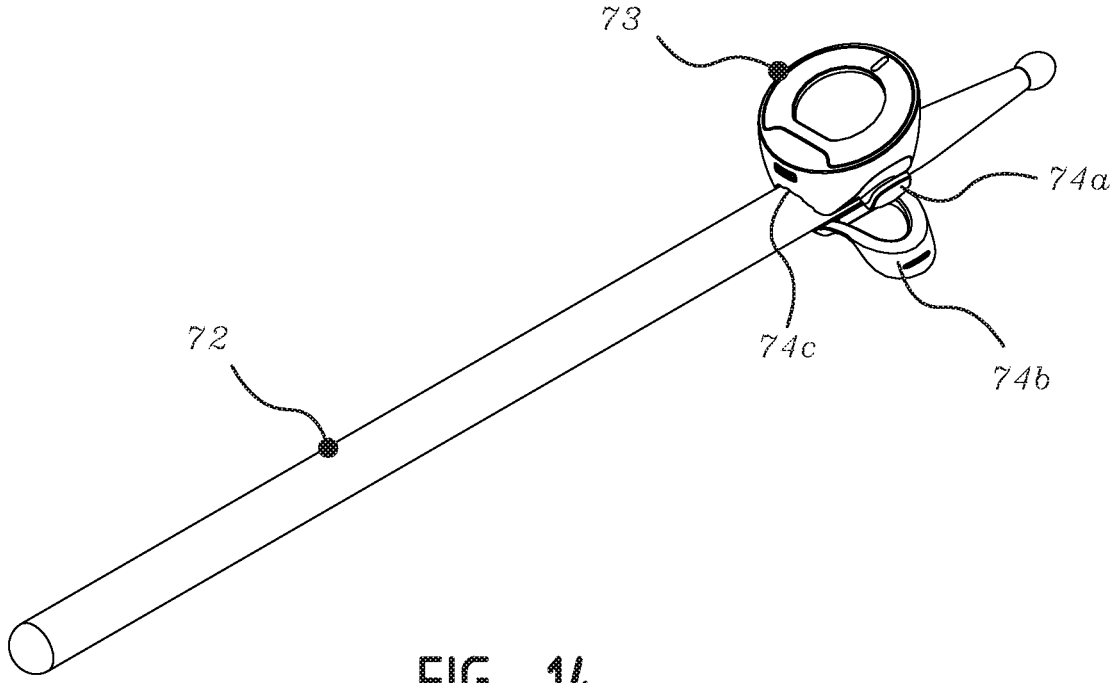
FIG. 14 illustrates a perspective view of an embodiment of the invention connected with a striking medium, whereby the connection means is represented as an elastic strap, and whereby said striking medium is represented as a drum stick.

FIG. 14 shows a perspective view of an apparatus for assisting a user in tuning a drum, that is a tuning apparatus 73, which is suitable for the tuning drums following the method and insights described in this text but not limited thereto, whereby the tuning apparatus 73 is outfitted to be connected to a strike medium 72 via a link, a bond or a connection 74 between at least a part of the tuning apparatus 73 and at least a part of the strike medium 72, and whereby the tuning apparatus contains a vibrations sensor 23. In a preferred embodiment, the apparatus 73 is fully integrated in a striking medium 72. The tuning apparatus 73 can also comprise a data processing device that can be coupled operationally to a digital storage medium for performing the steps of the tuning method of this invention, but not limited thereto.

In FIG. 14 the strike medium 72 is a drum stick, but it could be any strike medium 72 like for example: a brush, a mallet, a tube, a rod, a beater, or even a body part like a hand or an arm, but not limited thereto.

Hereby the connection between the tuning apparatus 73 and the strike medium 72 could be permanent or temporary. Alternatively the tuning apparatus 73 could be detachable from the strike medium 72 or it could be fully integrated in it, or with it so the tuning apparatus and the strike medium become one single device.

Hereby it could be possible that some form of link, bond or connection 74 is created between at least a part of the tuning apparatus 73 and at least a part of the strike medium 72, for example said link, bond or connection could be a mechanical connection by means of at least one the following: a mechanical fastener, a nail, a hook, a clamp, a pinch, a grip, a bolt, a screw, a tensioning rod, a set screw a dowel, a string, a cord, a rope, a strap, a vacuum suction cup, a tightening band, a pull force exerting means, a pressure force exerting means, a wrap, a sleeve, a hook and loop fastener, a chain, a buckle, a press fit, a fit with a cavity or a contraption of an enclosure or another means, a pin, a dowel, any other connection, but not limited thereto.

Alternatively it could be possible that some chemical form of link, bond or connection 74 is created between at least a part of the tuning apparatus 73 and at least a part of the strike medium 72, for example by means of a glue, an adhesive, a gel, a welding, any other chemical bond but not limited thereto.

Alternatively it could be possible that some other form of link, bond or connection 74 is created between at least a part of the tuning apparatus 73 and at least a part of the strike medium 72, for example by means of a vacuum force or a magnetic force, an electrostatic force, but not limited thereto.

As shown in FIG. 14 this particular embodiment has a connection 74 that consists of: a hook 74*a*, an elastic strap 74*b* that can be coupled to the hook 74*a*, and a grip area in a cavity of the enclosure 74*c* whereby when the strap 74*b* is coupled to the hook 74*a*, the force the elastic strap 74*b* secures the tuning apparatus 73 onto the striking medium 72. However, the apparatus of the invention is not limited to such a type of connection 74. For example: in another embodiment, the tuning apparatus 73 is fully integrated in a detachable mallet tip of a striking medium 72. In yet another embodiment, for example, the tuning apparatus 73 is fully integrated in a non-detachable mallet tip, or tip of a striking medium 72. In yet another embodiment, the tuning apparatus 73 is, for example, fully integrated in the shaft of a drumstick. The aforementioned embodiments are just examples of possible embodiments and the invention is not limited to the aforementioned embodiments.

FIG. 15 shows a back view of the tuning apparatus 73 coupled to a striking medium 72. In the shown embodiment, the tuning apparatus 73 is outfitted with a vibration sensor 23 which is preferably directed towards the striking surface of the striking medium 72, in this case the vibration sensor 23 is directed towards the tip of the drumstick. The embodiment shown in FIG. 13B also has at least one operation control like a button or selector 76 to operate the device and that can for example be used to operate a focus mode as shown in FIG. 10.

FIG. 16 shows a front view tuning apparatus 73 coupled to a striking medium 72. In the shown embodiment, the tuning apparatus is outfitted with visual communication means like a display 75 directed towards the user. Furthermore as yet shown in FIG. 14 the tuning apparatus 73 possesses a form of coupling, link, bond or connection 74 that comprises the aspects 74*a*, 74*b*, 74*c* as separately illustrated in FIG. 14. The form of coupling, link, bond or connection 74 connects the tuning apparatus 73 with the striking medium 72. The form of coupling, link, bond or connection 74 can for example also be a executed as an intermediate connection form, whereby at least one: a separate component, a clip, a clamping accessory, a holder, a separate part, an assembly of parts, or other, that is connecting with at least one of the following: the tuning apparatus 73, the striking medium 72, whereby the tuning apparatus 73 is coupled to the striking medium 72 in a permanent or temporary manner by means of the aforementioned intermediate connection form of the coupling, link, bond or connection 74.

One advantage of connecting a tuning apparatus 73 with a striking medium 72 is that a user has one free hand to operate a drum key when handling the tuning apparatus. This results in more freedom of handling, which makes the tuning of a drum more comfortable.

Another advantage of connecting a tuning apparatus 73 with a striking medium 72 is that the vibration sensor 23 can be registering sound fragments close to the area of impact on the drum. This avoids the problem of erratic tone detection due to sound fragment biasing compared to when a vibration sensor of a tuning apparatus is mounted in a static orientation and position in relation to the drumhead. Hereby erratic tone detections, whereby a fundamental tone is detected when an overtone is expected and vice versa, are reduced, and more robust detection of a fundamental tone or an overtone within the sound fragment can be achieved. This results in higher correct detection rate of a fundamental or an overtone.

When the vibration sensor 23 is directed towards the impact area on the drumhead, and in proximity of the impact area on the drumhead at the moment of impact, the locally generated sound can be registered locally by the vibration sensor 23, hereby enhancing the quality of the sound fragment and adding robustness to the detection of a strike and the detection of a tone like a fundamental or an overtone thereof, meanwhile reducing the chance for erratic tone detection.

In a preferred embodiment the abovementioned apparatus 73 is also outfitted with wireless communication means, in order to output data related to the tuning of a drum and/or a strike on a drum, like for example: a detected frequency or a detected difference with a target frequency, a sensor signal buffer, a power spectrum, an impact strength of a strike, the moment of impact, an impact location and/or in order to receive data as input like for example: tuning presets, instrument data 66, but not limited thereto.

The description above and the shown figures show embodiments of examples of the invention. The invention is however not limited to these examples and will be defined solely in the claims.

What is claimed is:

1. A method for assisting a user in tuning a drum, comprising:

detecting a strike on a drum within a sensor signal of a vibration sensor when at least one threshold value is exceeded, wherein the at least one threshold value is set to a signal characteristic of at least a part of the sensor signal, wherein the at least one threshold value is set in at least one of following domains:

a frequency domain, a complex domain;

recording a sound fragment of the strike by means of the vibration sensor;

transforming the sound fragment of the strike from a time domain into the frequency domain; and analyzing the sound fragment in the frequency domain in order to detect at least one of following: a fundamental tone of the drum, a first overtone.

2. The method according to claim 1, further comprising:

determining at least one of following characteristics of the strike:

an impact location, a hardness of the strike, an impact moment over time, a damping, a frequency distribution, a distribution and a progression of spectral content detected in the frequency domain over a determined time period, an acoustic envelope containing an acoustic signature related to the impact location.

3. The method according to claim 1, wherein the sensor signal of the vibration sensor contains at least two signal input channels, and wherein the method further comprises:

determining at least one of following characteristics of the strike:

an impact location; a hardness of the strike; an impact moment over time; a damping; a frequency distribution; a distribution and a progression of spectral content detected in the frequency domain over a determined time period; an acoustic envelope containing an acoustic signature related to the impact location; the fundamental tone of the drum; the first overtone.

4. The method according to claim 3, wherein the vibration sensor is physically arranged on at least one layer of a drumhead by at least one of the following techniques: printing, transferring, laminating, coating, welding, adhering.

5. The method according to claim 1, wherein the vibration sensor is physically arranged on at least one layer of a drumhead by at least one of the following techniques: printing, transferring, laminating, coating, welding, adhering.

* * * * *